US009551949B2

(12) United States Patent
Yamauchi et al.

(10) Patent No.: US 9,551,949 B2
(45) Date of Patent: Jan. 24, 2017

(54) ELECTROCONDUCTIVE MEMBER FOR ELECTROPHOTOGRAPHY, PROCESS CARTRIDGE, AND ELECTROPHOTOGRAPHIC APPARATUS

(71) Applicant: CANON KABUSHIKI KAISHA, Tokyo (JP)

(72) Inventors: Kazuhiro Yamauchi, Suntou-gun (JP); Satoru Yamada, Numazu (JP); Norifumi Muranaka, Yokohama (JP); Yuichi Kikuchi, Susono (JP); Tetsuo Hino, Yamato (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 113 days.

(21) Appl. No.: 14/666,734

(22) Filed: Mar. 24, 2015

(65) Prior Publication Data

US 2015/0198906 A1 Jul. 16, 2015

Related U.S. Application Data

(63) Continuation of application No. PCT/JP2014/004887, filed on Sep. 24, 2014.

(30) Foreign Application Priority Data

Sep. 27, 2013 (JP) ..... 2013-202659

(51) Int. Cl.
*G03G 15/02* (2006.01)
*G03G 15/08* (2006.01)
*G03G 15/16* (2006.01)

(52) U.S. Cl.
CPC ..... *G03G 15/02* (2013.01); *G03G 15/0233* (2013.01); *G03G 15/0818* (2013.01); *G03G 15/1685* (2013.01); *Y10T 428/249924* (2015.04)

(58) Field of Classification Search
CPC .... G03G 15/0233; G03G 15/02; G03G 15/14; G03G 15/0818; G03G 15/1685; D01D 5/0007; D01B 2401/16; Y10T 428/2495
See application file for complete search history.

(56) References Cited

U.S. PATENT DOCUMENTS 6,283,904 B1 9/2001 Itoh et al.
7,374,639 B2 * 5/2008 Ampulski ..... D21F 1/0036 162/116

(Continued)

FOREIGN PATENT DOCUMENTS

JP 8-272187 A 10/1996
JP 10-186805 A 7/1998

(Continued)

OTHER PUBLICATIONS

International Preliminary Report on Patentability, International Application No. PCT/JP2014/004887, Mailing Date Apr. 7, 2016.

(Continued)

*Primary Examiner* — Jason L Vaughan
(74) *Attorney, Agent, or Firm* — Fitzpatrick, Cella, Harper & Scinto

(57) ABSTRACT

To suppress an image trouble resulting from abnormal discharge independent of the use conditions and use environment of an electroconductive member, provided is an electroconductive member to be used while being brought into contact with a body to be contacted, the electroconductive member comprising a layer of a network structural body on an outer peripheral surface of a electroconductive support, in which: when a surface of the network structural body in a surface of the electroconductive member is observed, at least a part of the network structural body exists in an (Continued)

arbitrary square region having one side length of 200 μm; the network structural body contains non-electroconductive fibers; and an average fiber diameter of a top 10% of fiber diameters of the non-electroconductive fibers measured at arbitrary points is 0.2 μm or more and 15 μm or less.

8 Claims, 4 Drawing Sheets

(56) References Cited

U.S. PATENT DOCUMENTS

| | | | | |
|---|---|---|---|---|
| 7,917,064 | B2 * | 3/2011 | Nagamori | G03G 15/0233 399/176 |
| 8,257,641 | B1 * | 9/2012 | Qi | G03G 15/2057 264/172.15 |
| 8,265,525 | B2 * | 9/2012 | Wada | G03G 15/0233 399/176 |
| 8,422,906 | B2 | 4/2013 | Komiyama et al. | |
| 8,532,535 | B2 * | 9/2013 | Nose | G03G 15/0233 399/176 |
| 8,574,713 | B2 * | 11/2013 | Rutledge | D01D 5/0038 428/292.1 |
| 8,725,043 | B2 * | 5/2014 | Hoshio | G03G 15/0233 399/176 |
| 9,176,414 | B2 * | 11/2015 | Sato | G03G 15/0233 |
| 9,234,300 | B2 * | 1/2016 | Law | D01D 5/0007 |
| 9,274,496 | B2 * | 3/2016 | Miyagawa | G03G 21/18 |
| 2010/0291182 | A1 * | 11/2010 | Palasis | A61K 9/0024 424/426 |
| 2010/0297906 | A1 * | 11/2010 | Steckl | D01D 5/0084 442/347 |
| 2012/0224897 | A1 * | 9/2012 | Qi | B82Y 30/00 399/333 |
| 2014/0221184 | A1 | 8/2014 | Arimura et al. | |
| 2014/0287899 | A1 | 9/2014 | Nishioka et al. | |
| 2015/0198900 | A1 | 7/2015 | Yamada et al. | |
| 2015/0198904 | A1 | 7/2015 | Kikuchi et al. | |
| 2015/0198905 | A1 | 7/2015 | Kikuchi et al. | |
| 2015/0198907 | A1 | 7/2015 | Hino et al. | |

FOREIGN PATENT DOCUMENTS

| | | | |
|---|---|---|---|
| JP | 2000-274424 | A | 10/2000 |
| JP | 2002-268332 | A | 9/2002 |
| JP | 2009-300849 | A | 12/2009 |
| JP | 2011-123387 | A | 6/2011 |
| JP | 2011-232434 | A | 11/2011 |

OTHER PUBLICATIONS

U.S. Appl. No. 14/709,155, filed May 11, 2015. Inventor: Satoru Nishioka, et al.

U.S. Appl. No. 14/708,940, filed May 11, 2015. Inventor: Masaki Yamada, et al.

U.S. Appl. No. 14/715,477, filed May 18, 2015. Inventor: Sosuke Yamaguchi, et al.

International Search Report dated Nov. 11, 2014 in International Application No. PCT/JP2014/004887.

* cited by examiner

ELECTROCONDUCTIVE MEMBER FOR ELECTROPHOTOGRAPHY, PROCESS CARTRIDGE, AND ELECTROPHOTOGRAPHIC APPARATUS

CROSS-REFERENCE TO RELATED APPLICATIONS

This application is a continuation of International Application No. PCT/JP2014/004887, filed Sep. 24, 2014, which claims the benefit of Japanese Patent Application No. 2013-202659, filed Sep. 27, 2013.

BACKGROUND OF THE INVENTION

Field of the Invention

The present invention relates to an electroconductive member for electrophotography, a process cartridge, and an electrophotographic apparatus.

Description of the Related Art

In an electrophotographic apparatus as an image-forming apparatus adopting an electrophotographic system, an electroconductive member has been finding use in various applications, e.g., an electroconductive roller such as a charging roller, a developing roller, or a transfer roller. The electrical resistance value of such electroconductive roller needs to be controlled to from $10^3$ to $10^{10}\Omega$ independent of its use conditions and use environment. Accordingly, the roller is provided with an electroconductive layer having added thereto an electron conductive agent typified by carbon black or an ion conductive agent such as a quaternary ammonium salt compound, the electron conductive agent or the ion conductive agent being added for adjusting the electroconductivity of the electroconductive layer. Each of those two kinds of electroconductive agents has advantages and disadvantages.

An electron conductive roller obtained by adding the carbon black has the following advantages. A change in its electrical resistance value due to its use environment is small and there is a low possibility that the roller contaminates an electrophotographic photosensitive member (hereinafter referred to as "photosensitive member"). On the other hand, however, the following has been known. It is difficult to uniformly disperse the carbon black, and hence unevenness in the electrical resistance value resulting from the agglomeration of the carbon black occurs, and in particular, there is a possibility that a low-resistance site locally occurs. Even when the addition amount, of the carbon black is adjusted to optimize the electrical resistance value of the entirety of the conductive roller, it is not easy to prevent the local occurrence of the low-resistance site.

In an ion conductive roller obtained by adding the ion conductive agent, the ion conductive agent is uniformly dispersed in a binder resin as compared with the electron conductive roller. Accordingly, unevenness in its electrical resistance value resulting from the dispersion unevenness of the conductive agent can be reduced, and the local occurrence of a low-resistance site observed in an electron conductive system is hardly observed. On the other hand, however, the ion-conducting performance of the ion conductive roller is affected by the amount of moisture in the binder resin under its use environment in an extremely strong manner. Accordingly, it has been known that the electrical resistance value increases owing to the drying of a material for the roller particularly under a low-temperature and low-humidity environment having a temperature of 15° C. and a relative humidity of 10% (hereinafter sometimes referred to as "L/L environment"). Accordingly, it is not easy to secure sufficient electroconductivity under the low-temperature and low-humidity environment.

Japanese Patent Application Laid-Open No. 2000-274424 discloses an approach involving using the ion conductive agent and the electron conductive agent in combination as means for adjusting the electrical resistance value of the electroconductive roller to a proper region independent of its use conditions and use environment.

In addition, Japanese Patent Application Laid-Open No. H08-272187 discloses, as an approach involving uniformizing the electrical resistance of a charging member to uniformly charge the surface of a photosensitive member, a charging member having an electron conductive fiber-entangled body. In addition, Japanese Patent Application Laid-Open. No. H10-186805 discloses, as means for uniformly charging the surface of a body to be charged, a charging device in which a uniform fine void is formed between a charging electrode and the body to be charged by winding a thread-like member around the charging electrode and fixing the member.

SUMMARY OF THE INVENTION

In a charging roller as an example of the electroconductive roller that is placed so as to abut with a photosensitive member in an electrophotographic apparatus and charges the photosensitive member through the application of a direct-current voltage, when the resistance of the charging roller falls short of a proper resistance region, discharge does not stabilize and hence excessive discharge locally occurs in some cases. At that time, the surface of the photosensitive member locally undergoes excessive charging, and as a result, an image with a blank dot may occur. The foregoing is liable to occur in an electron conductive charging roller in which a low-resistance site may locally occur. Meanwhile, also when the resistance of the charging roller exceeds the optimum resistance region, the discharge does not stabilize and hence a fine horizontal streak-like image failure occurs owing to a discharge failure in some cases. The foregoing is liable to occur in an ion conductive charging roller that may cause a charging failure particularly under the L/L environment. As described above, the electron conductive charging roller and the ion conductive charging roller have different features in terms of electrical characteristics, but each involve a problem in that its resistance may deviate from the proper resistance region. As a result, the discharge becomes instable, which may be responsible for the occurrence of an image trouble derived from abnormal discharge.

In addition, when a charging roller is used in an AC/DC charging system as a system involving applying a voltage obtained by superimposing an alternating-current voltage (AC voltage) on a direct-current voltage (DC voltage) to the charging roller, a spot-like image failure derived from abnormal discharge called a sandy image occurs in some cases. In the case of a transfer roller as another example of the electroconductive roller as well, an image trouble derived from the abnormal discharge may occur.

As described above, it is difficult to stably control the electrical resistance value of the electroconductive roller such as a charging roller or a transfer roller, and the electrical resistance value needs to be controlled to a proper resistance region. The roller involves the following drawback. When the electrical resistance value deviates from the proper resistance region, stable discharge is hardly obtained and hence such various image troubles as described above may occur.

Available as means for controlling the electrical resistance value of the electroconductive roller to the proper region is the approach involving using the electron conductive agent and the ion conductive agent in combination disclosed in Japanese Patent Application Laid-Open No. 2000-274424. However, it is not easy for the approach of Japanese Patent Application Laid-Open No, 2000-274424 to exploit the merits of both the electron conductive agent and the ion conductive agent at the same time through the combined use thereof. In addition, in today's circumstances where an increase in speed of an electrophotographic apparatus and the lengthening of its lifetime are required, the proper region of the electrical resistance value tends to narrow, and hence it may be difficult to control the discharge characteristic of the electroconductive roller through the optimisation of the electrical resistance value.

In addition, the approach of Japanese Patent Application Laid-Open No. H08-272187 involves using an electroconductive fiber in the surface of the charging member. Accordingly, when the charging member of Japanese Patent Application Laid-Open No. H08-272187 is applied as it is to an electroconductive member for electrophotography, local excessive discharge cannot be sufficiently suppressed in some cases. Although the approach of Japanese Patent Application Laid-Open No. H10-186805 exhibits an effect by which a stable void is formed between the charging electrode and the body to be charged, a discharge site is the same as a conventional one. Accordingly, when the electroconductive member of Japanese Patent Application Laid-Open No. H10-186805 is applied as it is to the electroconductive member for electrophotography, an effect enough to stabilize the discharge is not obtained in some cases.

The present invention has been made in view of such technological background, and the present invention is directed to providing an electroconductive member suppressed in image trouble caused by abnormal discharge independent of its use conditions and use environment. Further, the present invention is directed to providing a process cartridge and an electrophotographic apparatus each of which can stably form a high-quality electrophotographic image over a long time period.

According to one aspect of the present invention, there is provided an electroconductive member for electrophotography to be used while being brought into contact with a body to be contacted, the electroconductive member comprising: an electroconductive support; and a layer of a network structural body on an outer peripheral surface thereof, in which: when a surface of the network structural body in a surface of the electroconductive member is observed, at least a part of the network structural body exists in an arbitrary square region having one side length of 200 μm; the network structural body contains non-electroconductive fibers; and an average fiber diameter of a top 10% of fiber diameters of the non-electroconductive fibers measured at arbitrary points is 0.2 μm or more and 15 μm or less.

According to another aspect of the present invention, there is provided a process cartridge detachably mountable to a main body of an electrophotographic apparatus, the process cartridge comprising the electroconductive member for electrophotography.

According to further aspect of the present invention, there is provided an electrophotographic apparatus, comprising the electroconductive member for electrophotography.

According to the present invention, independent of the use conditions and use environment of the electroconductive member, even when the electrical resistance value of the electroconductive member cannot be strictly controlled, the occurrence of an image trouble resulting from abnormal discharge can be suppressed by stabilizing discharge.

Further, according to the present invention, the process cartridge and the electrophotographic apparatus capable of forming a high-quality electrophotographic image can be obtained.

Further features of the present invention will become apparent from the following description of exemplary embodiments with reference to the attached drawings.

DESCRIPTION OF THE EMBODIMENTS

Figure 1A:
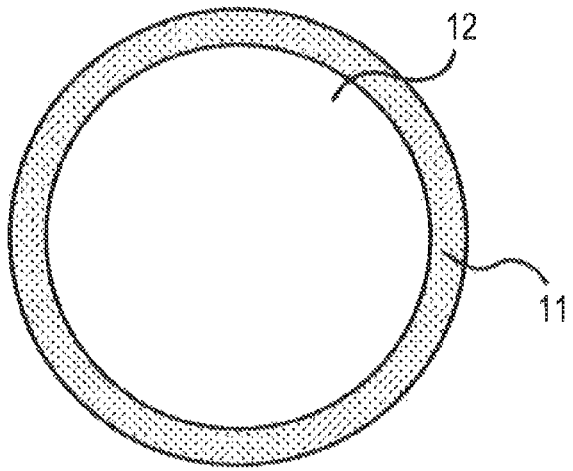
FIG. 1A is a view illustrating an example of an electroconductive member for electrophotography according to the present invention.

Preferred embodiments of the present invention will now be described in detail in accordance with the accompanying drawings.

The inventors of the present invention have found that discharge is stabilized in an electroconductive member obtained by forming a layer of a network structural body containing non-electroconductive fibers on the outer peripheral surface of an electroconductive support, and hence the member has a suppressing effect on an image trouble resulting from abnormal discharge.

To verify the discharge-stabilizing effect, the inventors of the present invention have directly observed discharge light generated between the electroconductive member according to the present invention and a photosensitive member with a high-sensitivity small camera. As a result, the inventors nave confirmed that when a specific layer of a network structural body exists on the outer peripheral surface of the electroconductive support, a phenomenon in which the scale of single discharge is reduced and the frequency of discharge increases occurs. The phenomenon is significantly observed by virtue of the presence of the specific layer of the network structural body. It should be noted that the term "stabilization of discharge" as used in the present invention means both the suppression of abnormal discharge by the reduction of the scale of discharge and an improvement in charging ability by an increase in frequency of the discharge.

The inventors have confirmed that when the discharge light is observed, an image with a blank dot caused by local excessive discharge is liable to occur upon enlargement of single discharge. Meanwhile, the inventors have confirmed that an image with a horizontal streak due to a discharge failure is liable to occur when discharge is instable and hence the photosensitive member is not sufficiently charged. In other words, the inventors have assumed that the layer of the network structural body according to the present invention reduces the scale of single discharge to suppress the occurrence of the image failure derived from the excessive discharge and increases the frequency of discharge to improve the charging ability, and at the same time, to suppress the occurrence of the horizontal streak-like image failure resulting from the instable discharge.

The inventors of the present invention have assumed reasons why the layer of the network structural body reduces the scale of the single discharge and improves the charging ability to be as described below.

First, the inventors have considered that it is because the layer of the network structural body containing the non-electroconductive fibers exists between the electroconductive member and the photosensitive member that the scale of the discharge is reduced. The inventors have confirmed that when the electroconductive member of the present invention is used in the observation of the discharge light, a discharge phenomenon does not occur from the surface of the network structural body but mainly occurs between the electroconductive support and the photosensitive member. Therefore, in a process in which a free electron discharged from the electroconductive support or a free electron generated by the ionization of a gas present in a space diffuses while colliding with a gas molecule in the space, in the present invention, the diffusion of the free electron is suppressed because the network structural body exists in the space. In other words, the inventors have considered that the layer of the network structural body reduces the scale of a discharge space itself to suppress the diffusion of the free electron to suppress the enlargement of the single discharge, and as a result, the scale of the discharge is reduced. On the other hand, when fibers forming the network structural body are electroconductive fibers, the discharge occurs from the fibers themselves and hence a suppressing effect on the diffusion of the free electron by the reduction of the scale of the discharge space is not exhibited. Accordingly, the inventors have considered that the discharge from the fibers forming the network structural body themselves, in particular, from the surfaces of the fibers needs to be suppressed by making the fibers non-electroconductive.

Second, the inventors have considered that it is because many fine spaces subdivided by the non-electroconductive fibers are present in the layer of the network structural body that the charging ability improves as a result of the increase in frequency of the discharge. As in the first reason, the inventors of the present invention have assumed that the discharge occurs in the fine spaces subdivided by the fibers, and hence have considered that as the number of the fine spaces increases, the possibility that the number of spaces in each of which single discharge occurs increases becomes higher. Examples of possible causes for the increase in number of the fine spaces include the thickness of the layer of the network structural body and reductions in diameters of the fibers.

The inventors have assumed that the presence of the layer of the network structural body on the outer peripheral surface of the electroconductive support stabilizes the discharge because of such reasons as described above.

Hereinafter, the present invention is described in detail. It should be noted that hereinafter, the electroconductive member for electrophotography is described based on a charging member as a typical example thereof, but the applications of the electroconductive member of the present invention are not limited only to the charging member.

<Electroconductive Member>

Figure 1B:
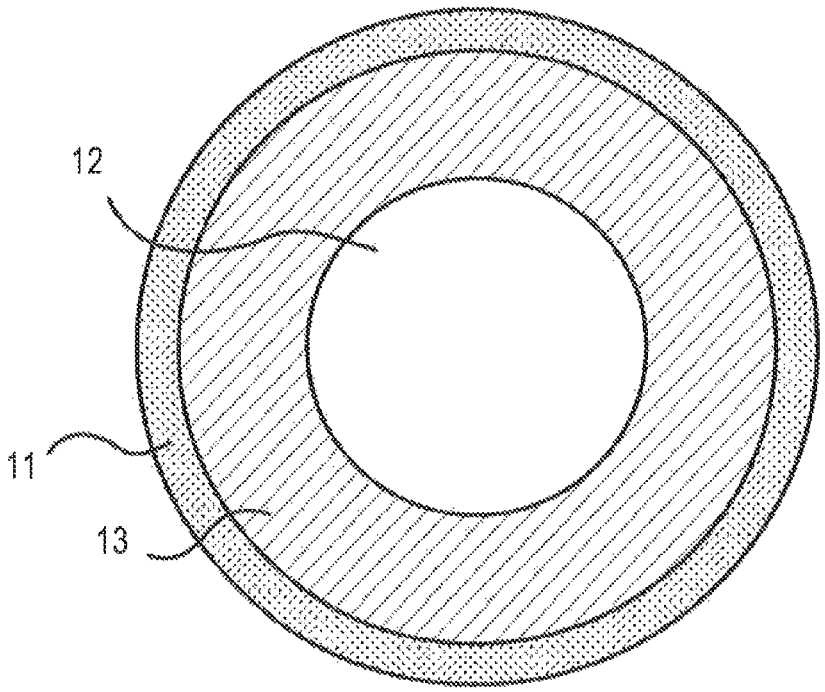
FIG. 1B is a view illustrating an example of the electroconductive member for electrophotography according to the present invention.

An electroconductive member according to the present invention has the layer of a network structural body on the outer peripheral surface of an electroconductive support. FIG. 1A and FIG. 1B each illustrate a schematic view of the electroconductive member (charging member) for electrophotography according to the present invention. The charging member can be of a construction formed of, for example, an electroconductive mandrel 12 as the electroconductive support and a layer 11 of a network structural body formed on the outer periphery thereof as illustrated in FIG. 1A. In addition, the charging member can be of a construction in which the electroconductive mandrel 12 and an electroconductive resin layer 13 formed on the outer periphery thereof are used as the electroconductive support, and the layer 11 of the network structural body is further formed on the outer periphery thereof as illustrated in FIG. 1B. As described above, the electroconductive support may have the electroconductive resin layer on the outer periphery of the mandrel. It should be noted that the charging member may be of a multilayer construction in which a plurality of the electroconductive resin layers 13 are placed as required as long as the effects of the present invention are not impaired.

<Electroconductive Support>

[Electroconductive Mandrel]

A mandrel appropriately selected from those known in the field of an electroconductive member for electrophotography can be used as the electroconductive mandrel. The mandrel is, for example, a cylindrical material obtained by plating the surface of a carbon steel alloy with nickel having a thickness of about 5 μm.

[Electroconductive Resin Layer]

A rubber material, a resin material, or the like can be used as a material constituting the electroconductive resin layer. The rubber material is not particularly limited, and a rubber known in the field of an electroconductive member for electrophotography can be used. Specific examples thereof include an epichlorohydrin homopolymer, an epichlorohydrin-ethylene oxide copolymer, an epichlorohydrin-ethylene oxide-allyl glycidyl ether terpolymer, an acrylonitrile-butadiene copolymer, a hydrogenated product of an acrylonitrile-butadiene copolymer, a silicone rubber, an acrylic rubber, and a urethane rubber. A resin known in the field of an electroconductive member for electrophotography can be used as the resin material. Specific examples thereof include an acrylic resin, polyurethane, polyamide, polyester, polyolefin, an epoxy resin, and a silicone resin.

An electron conductive agent or an ion conductive agent may be blended in the rubber for forming the electroconductive resin layer in order to adjust its electrical resistance value as required. Examples of the electron conductive agent include: carbon black and graphite, which exhibit electron conductivity; oxides such as tin oxide; metals such as copper and silver; and electroconductive particles to each of which electroconductivity is imparted by covering its particle surface with an oxide or metal. In addition, examples of the ion conductive agent include ion conductive agents each having ion exchange performance such as a quaternary ammonium salt and a sulfonic acid salt, which exhibit ion conductivity.

In addition, a filler, softening agent, processing aid, tackifier, antitack agent, dispersant, foaming agent, roughening particle, or the like which has been generally used, as a blending agent for a resin can be added to the extent that the effects of the present invention are not impaired.

As a guideline on the electrical resistance value of the electroconductive resin layer, its volume resistivity is $1\times10^3$ Ωcm or more and $1\times10^9$ Ωcm or less. It should be noted that the inventors have confirmed that the layer of the network structural body according to the present invention can suppress an image trouble resulting from excessive discharge even when the electrical resistance value of the electroconductive support is sufficiently low. In particular, when the electroconductive resin layer is electron conductive, a stabilizing effect on the excessive discharge is significant, and hence an electroconductive resin layer showing electron conductivity is preferably used in consideration of environmental characteristics.

<Layer of Network Structural Body>

It is important that the layer of the network structural body (hereinafter sometimes referred to as "surface layer") according to the present invention be of the following construction from the viewpoint of suppressing abnormal discharge.

[Mesh-to-Mesh Distance of Network Structural Body]

It is important to control the mesh-to-mesh distance of the layer of the network structural body of the present invention. The size of giant discharge resulting from excessive discharge to be observed at the time of the observation of discharge light is from about 200 to 700 μm. The mesh-to-mesh distance in the layer of the network structural body needs to be set so as to be equal to or less than the size of the giant discharge because the giant discharge needs to be divided and reduced in scale with the layer of the network structural body. The discharge occurs in a direction perpendicular to the surface of the electroconductive member. Accordingly, when the mesh-to-mesh distance of the network structural body is equal to or less than the size of the giant discharge upon observation of the layer of the network structural body from a direction perpendicular to its surface, a suppressing effect on the abnormal discharge is obtained. Because of such reason as described above, 100 arbitrary square region having one side length of 200 μm (each measuring 200 μm long by 200 μm wide) are measured and observed from the direction perpendicular to the surface of the layer of the network structural body with an optical microscope, a laser microscope, or the like. The inventors have confirmed that when at least a part of the network structural body of the present invention can be observed in each of all the 100 measurement points, the giant discharge can be divided and reduced in scale. Although an image to be observed at that time is information obtained by integrating all pieces of information in the thickness direction of the layer of the network structural body, the inventors have considered that a judgment method of the present invention involves no problems because the mesh-to-mesh distance in the surface of the layer of the network structural body including the information in the thickness direction affects a scale-reducing effect on the size of the discharge.

It should be noted that at least a part of the network structural body preferably exists in an arbitrary square region having one side length of 100 μm on the surface of the electroconductive member. In addition, at least a part of the network structural body particularly preferably exists in an arbitrary square region having one side length of 25 μm on the surface of the electroconductive member. When part of the network structural body is observed in a square region having one side length of 100 μm, not only the reduction of the scale of single discharge but also an increasing effect on the frequency of discharge is observed in an additionally strong manner. In addition, when part of the network structural body is observed in a square region having one side length of 25 μm, the increasing effect on the frequency of the discharge appears in an extremely strong manner.

[Three-dimensional Structure of Layer of Network Structural Body]

The layer of the network structural body (surface layer) of the electroconductive member according to the present invention preferably has a structure in which fibers are three-dimensionally placed and which has an extremely large porosity. The inventors have considered that a state in which a space in the surface layer is divided by the group of fibers is important for the expression of the scale-reducing effect on the discharge and the increasing effect on the frequency of the discharge. It should be noted that an x-axis, y-axis, and z-axis in the present invention are three axes perpendicular to one another, and the z-axis direction is a direction perpendicular to the surface layer of the electroconductive member. In addition, when the electroconductive member has a roller shape, the x-axis direction is a tangential direction in a horizontal cross section (i.e., circular end surface) of the roller and the y-axis direction is the longitudinal direction of the roller.

The inventors of the present invention have defined the structure of the surface layer as described below from the viewpoints of the respective fibers and spaces occupied by the fibers. First, the surface layer is cut out of the electroconductive member, and a cross-sectional image of a cross section (one of a yz cross section and an xz cross section) of the surface layer is acquired with an X-ray CT inspector. The resultant cross-sectional image is binarized, a cross-sectional image of the fibers is sampled, the group of images of the fiber cross sections in the cross-sectional image is subjected to Voronoi tessellation, and a space in the surface layer occupied by the cross section of each fiber is defined.

Here, the Voronoi tessellation is to classify a plurality of points (generating points) placed at arbitrary positions on a plane into regions depending on which one of the generating points any other point on the same metric space is close to. In particular, in the case of a two-dimensional Euclidean plane, the Voronoi tessellation is an approach involving drawing a perpendicular bisector on a straight line connecting the centers of gravity of generating points adjacent to each other and dividing the nearest region of each fiber with the perpendicular bisector. In addition, the nearest region of each generating point obtained by performing the Voronoi tessellation is called a Voronoi polygon. It is because the perpendicular bisector of the respective generating points adjacent to each other is unambiguously determined and hence the Voronoi polygon is also unambiguously determined that the Voronoi tessellation is employed.

The inventors of the present invention have actually performed the Voronoi tessellation as described below. First, two straight lines included in two lines of intersection of two planes perpendicular to the z-axis and passing the centers of gravity of fiber cross sections placed at the uppermost end and lowermost end in the image of the fiber cross sections (yz cross sections), and the fiber cross sections (yz cross sections), the two straight lines having the same length as the width of the image of the fiber cross sections, were drawn so as to be included in the image of the fiber cross sections. Here, the uppermost end and lowermost end in the image of the fiber cross sections are as follows: in a cross-sectional image before the cutout of only the cross-sectional image of the fibers, the fiber cross section whose shortest distance from the electroconductive support is largest in the fiber cross-sectional image group is the uppermost end, and the fiber cross section whose shortest distance therefrom is smallest is the lowermost end. In addition, the two straight lines were defined as "borderlines of the occupied region of the surface layer," and a rectangle obtained by connecting end portions on the same side of the two straight lines with a straight line was defined as the "occupied region of the surface layer." Next, in the occupied region, the Voronoi tessellation was performed by using the fiber cross sections as generating points. The reasons why such procedure was adopted are as described below. Each of the fiber cross sections in the uppermost portion and lowermost portion in the cross-sectional image can define a region-dividing line between fibers adjacent to each other in the direction parallel to the surface of the electroconductive member (y-axis direction), but in the direction perpendicular to the surface of the electroconductive member (z-axis direction), cannot form any region-dividing line owing to the insufficiency of the number of generating points. In addition, the following drawback occurs also in the case where the thickness of the surface layer is small: unless the foregoing measures are taken, a state where a plurality of fiber cross sections are present in the direction perpendicular to the surface of the electroconductive member in the cross sectional image is not established, and hence a generating point that cannot define any Voronoi polygon occurs.

The inventors of the present invention have made extensive studies, and as a result, have found that it is important to optimize a ratio "$S_1/S_2$" (hereinafter sometimes referred to as "area ratio k"). Each of areas of Voronoi polygons in the yz section obtained by the above-mentioned method is defined as $S_1$. And each of cross-sectional areas in the cross section of the fibers as the generating points of the respective Voronoi polygons is defined as $S_2$. That is, when the area of a Voronoi polygon is optimized for each fiber in the surface layer, a subdividing effect on abnormal discharge occurs, and hence the abnormal discharge and weak discharge can be additionally suppressed, and a charged potential on the surface of a photosensitive drum becomes independent of the pattern of the fibers. Accordingly, a good image is obtained.

Specifically, when a value for $k^{U10}$ as an arithmetic average of the top 10% of the area ratios k is 160 or less, the occurrence of a pore larger than the size of the abnormal discharge (from, about 200 to 700 μm) is suppressed and hence the abnormal discharge is easily suppressed. Meanwhile, when the value for $k^{U10}$ is 40 or more, a charging failure or direct output of the pattern of the fibers on an image hardly occurs. Because of the reasons, the value for $k^{U10}$ is preferably 40 or more and 160 or less. The value for $k^{U10}$ is more preferably 60 or more and 160 or less. Setting the value for $k^{U10}$ to 60 or more and 160 or less significantly improves the subdividing effect on the abnormal discharge.

[Layer Thickness of Network Structural Body]

As described in the foregoing, it is important that the layer of the network structural body according to the present, invention be present in a discharging space between the electroconductive member and the photosensitive member from the viewpoint of suppressing abnormal discharge. Accordingly, in addition to the mesh-to-mesh distance, an average thickness $t^1$ of the layer of the network structural body is preferably 10 μm or more and 200 μm or less. When the average thickness $t^1$ is 10 μm or more, a scale-reducing effect on discharge and a stabilizing effect on the discharge are obtained. Meanwhile, setting the average thickness $t^1$ to 200 μm or less can prevent a charging failure due to the insulation of the electroconductive member even when the layer of the network structural body contains non-electroconductive fibers like the present invention. The average thickness $t^1$ is more preferably 30 μm or more and 120 μm or less, particularly preferably 30 μm or more and 90 μm or less from the viewpoint of additionally improving the stabilizing effect on the discharge.

It should be noted that the thickness as used herein refers to the thickness of the layer of the network structural body measured in a direction perpendicular to the surface of the electroconductive support, and means the thickness of the layer in a state of being out of contact with any other member. The thickness can be measured by: cutting a section including the electroconductive support and the layer of the network structural body out of the electroconductive member according to the present invention; and performing X-ray CT measurement. In addition, the average thickness $t^1$ is the average of thicknesses measured in a total of 25 fiber cross sections obtained by: dividing the electroconductive member into 5 equal parts in its longitudinal direction; and selecting 5 arbitrary sites in each part.

[Average Layer Thickness of Contact Portion of Network Structural Body]

With regard to the thickness of the layer of the network structural body according to the present invention, an average thickness $t^2$ of a contact portion at the time of contact between the electroconductive member and a body to be contacted is preferably 1 μm or more and 50 μm or less. As described in the foregoing, the layer of the network structural body of the present invention is non-electroconductive, and hence discharge mainly occurs between the electroconductive support and the body to be contacted (such as a photosensitive member). According to Paschen's law, whether the discharge occurs depends on a gap distance between the electroconductive support of the electroconductive member and the photosensitive member as the body to be contacted, and hence the discharge itself does not occur depending on the thickness of the layer of the network structural body. Accordingly, setting the average thickness $t^2$ of the layer of the network structural body in the contact portion of the electroconductive member and the body to be contacted, in other words, a nip portion to 50 μm or less leads to stable occurrence of the discharge. Further, the average thickness $t^2$ of the contact portion is more preferably 20 μm or less, particularly preferably 10 μm or less in order that the discharge may be additionally stabilized. In addition, the average thickness $t^2$ is the average of thicknesses measured at a total of 25 sites obtained as follows at the time of the contact between the electroconductive member and the body to be contacted, and means the average of the shortest distances connecting the electroconductive member and the body to be contacted: the electroconductive member is divided into 5 equal parts in its longitudinal direction and 5 arbitrary sites are selected in each part.

The average thickness $t^2$ can be measured as described below. The layer of the network structural body is stripped off at the time of the contact between the electroconductive member and the body to be contacted, and the gap distance of a gap produced as a result of the stripping is measured with a gap inspection machine by irradiating the gap with laser.

It should be noted that the average thickness $t^1$ in a non-contact portion is preferably 10 μm or more and 200 μm or less as described in the foregoing. From the viewpoint of expressing the effects of the present invention, in a discharge region to be formed between the electroconductive member of the present invention and the photosensitive member as the body to be contacted, it is important that the layer of the network structural body be present in a state of having many fine pores without being compressed. Meanwhile, in the contact portion of the electroconductive member of the present invention and the photosensitive member, the average thickness $t^2$ of the layer of the network structural body is preferably set to 50 μm or less in order that the discharge region may be secured. In other words, the inventors have considered that when the electroconductive member of the present invention is used while being mounted on an electrophotographic apparatus, it is important that the layer of the network structural body of the present invention be used in a state where compression and recovery in its thickness direction are repeated from the viewpoint of expressing the effects.

[Form of Non-Electroconductive Fibers]

The non-electroconductive fibers forming the layer of the network structural body of the present invention each preferably have a length 100 or more times as long as its fiber diameter. It should be noted that whether the fiber length is 100 or more times as long as the fiber diameter can be confirmed by observing the layer of the network structural body with an optical microscope or the like. The cross-sectional shapes of the fibers are not particularly limited, and examples thereof include a circular shape, an elliptical shape, a quadrangular shape, a polygonal shape, a semicircular shape, and any other cross-sectional shape. Cross-sectional shapes in the longitudinal direction of a fiber may be different. It should be noted that when the cross section of a fiber is cylindrical, its fiber diameter is the diameter of the circle of the cross section, and when the cross section is non-cylindrical, the fiber diameter is the length of the longest straight line passing the center of gravity in the fiber cross section.

The layer of the network structural body forms the outermost layer of the electroconductive member of the present invention. Accordingly, when the fiber diameters of the non-electroconductive fibers are thick, the pattern of the fibers may appear as image unevenness at the time of print output. To prevent the phenomenon in which the pattern of the fibers appears as the image unevenness, the fiber diameters of the non-electroconductive fibers each need to be equal to or less than a predetermined value because the pattern may appear as the image unevenness even when a thick site is present in part of a fiber. An average fiber diameter $d^{10}$ of the top 10% of the fiber diameters of the non-electroconductive fibers is 0.2 μm or more and 15 μm or less. Setting the average fiber diameter $d^{10}$ of the top 10% to 15 μm or less makes it hard to observe the pattern of the fibers as the image unevenness when the print output is performed at 600 dpi. An upper limit therefor is preferably 5 μm or less, more preferably 2.5 μm or less. Setting the upper limit to 5 μm or less makes it hard to observe the pattern of the fibers as the image unevenness when the print output is performed at 1,200 dpi. In addition, setting the upper limit to 2.5 μm or less substantially precludes the observation of the pattern of the fibers as the image unevenness when the print output is performed irrespective of a resolution.

Meanwhile, the average fiber diameter $d^{10}$ of the top 10% is 0.2 μm or more. When the average fiber diameter $d^{10}$ of the top 10% is less than 0.2 μm, a suppressing effect on abnormal discharge is not sufficiently obtained. An average fiber diameter d is the average of diameters, each of which is the diameter of a cross section perpendicular to the direction of a fiber axis, measured in a total of 50 fiber cross sections obtained by: dividing the electroconductive member into 5 equal parts in its longitudinal direction; and selecting 10 arbitrary sites in each parts. It should be noted that when the cross section perpendicular to the direction of the fiber axis is elliptical, the average of its long diameter and short diameter is defined as the diameter.

In addition, in the present invention, the average fiber diameter $d^{10}$ of the top 10% is the average of the diameters of fibers whose diameters rank in the top 10% of 50 arbitrary fibers selected upon measurement of the average fiber diameter d (i.e., 5 fibers).

In addition, the average fiber diameter d of the non-electroconductive fibers is preferably made thin and uniform from the viewpoint of suppressing abnormal discharge and from the viewpoint of making it difficult for the pattern of the fibers to appear as image unevenness at the time of the print output. Specifically, the average fiber diameter d is 10 μm or less, preferably 3 μm or less, more preferably 1 μm or less, and a standard deviation for the average fiber diameter d is within 50%, preferably within 30%, more preferably within 20%. The inventors have succeeded in confirming that setting the average fiber diameter a to 10 μm or less exhibits a scale-reducing effect on single discharge. Further, the inventors have confirmed that setting the average fiber diameter d to 3 μm or less exhibits the scale-reducing effect on the single discharge and an increasing effect on the frequency of discharge. The inventors have assumed that this is because reductions in diameters of the fibers result in the formation of many fine spaces contributing to the occurrence of the single discharge.

Further, setting the average fiber diameter d to 1 μm or less exhibits the scale-reducing effect on the single discharge and a significant increasing effect on the frequency of the discharge. In addition, setting the average fiber diameter d to 0.2 μm or more exhibits a suppressing effect on abnormal discharge. In addition, when the distribution of the fiber diameters in the layer of the network structural body of the present invention is made small and the standard deviation for the average fiber diameter d is set to within 70%, the following effect is observed; the pattern of the fibers hardly appears as image unevenness at the time of print output. Further, the standard deviation for the average fiber diameter d is preferably within 50%, more preferably within 30%.

The standard deviation for the average fiber diameter d is the ratio of a value for a standard deviation determined from the diameters of 50 arbitrary fibers selected upon measurement of the average fiber diameter d to the average fiber diameter d.

It should be noted that the average fiber diameter d and the average fiber diameter $d^{10}$ of the top 10% can be confirmed by direct observation based on, for example, measurement with an optical microscope, a laser microscope, or a scanning electron microscope (SEM). The layer of the network structural body according to the present invention is observed from the surface side and subjected to measurement with the scanning electron microscope (SEM), and the diameters of 50 arbitrary fibers are measured. As described in the foregoing, the average of the diameters of the 50 arbitrary fibers is the average fiber diameter d of the present invention. In addition, the average of the diameters of 5 fibers whose diameters correspond to the top 10% of the 50 arbitrary fibers is the average fiber diameter $d^{10}$ of the top 10% of the present invention.

[Non-Electroconductive Fibers]

It is important that the layer of the network structural body according to the present invention contains the non-electroconductive fibers. The non-electroconductive fibers are not particularly limited as long as the fibers form a fibrous structure, and an organic material typified by a resin material, an inorganic material such as silica or titania, or a material obtained by hybridizing the organic material and the inorganic material may be used.

Examples of the resin material include: a polyolefin-based polymer such as polyethylene or polypropylene; polystyrene; polyimide, polyamide, and polyamide imide; a polyarylene (aromatic polymer) such as polyparaphenylene oxide, poly(2,6-dimethylphenylene oxide), or polyparaphenylene sulfide; a polymer obtained by introducing a sulfonic acid group (—$SO_3H$), a carboxyl group (—COOH), a phosphoric acid group, a sulfonium group, an ammonium group, or a pyridinium group into a polyolefin-based polymer, polystyrene, polyimide, or a polyarylene (aromatic polymer); a fluorine-containing polymer such as polytetrafluoroethylene or polyvinylidene fluoride; a perfluorosulfonic acid polymer, perfluorocarboxylic acid polymer, or perfluorophosphoric acid polymer, which is obtained by introducing a sulfonic acid group, a carboxyl group, or a phosphoric acid group into a skeleton of a fluorine-containing polymer; a polybutadiene-based compound; a polyurethane-based compound such as an elastomer or gel; a silicone-based compound; polyvinyl chloride; polyethylene terephthalate; nylon; and polyarylate. It should be noted that one kind of those polymers may be used alone, or a plurality of kinds thereof may be used in combination. In addition, those polymers may be functionalized, or a copolymer produced from a combination of two or more kinds of monomers to be used as raw materials for those polymers may be used.

Examples of the inorganic material include oxides of Si, Mg, Al, Ti, Zr, V, Cr, Mn, Fe, Co, Ni, Cu, Sn, and Zn. More specific examples thereof include metal oxides such as silica, titanium oxide, aluminum oxide, alumina sol, zirconium oxide, iron oxide, and chromium oxide.

In addition, the material constituting the layer of the network structural body according to the present invention is preferably a material having high adhesiveness with the electroconductive support. The use of the material having high adhesiveness with the electroconductive support enables the construction of an electroconductive member in which the electroconductive support and the layer of the network structural body are laminated and joined without the use of an adhesive (pressure-sensitive adhesive) or the like. To this end, it is preferred that the material partially have a polar functional group.

The non-electroconductive fibers according to the present invention are specifically fibers each having a volume resistivity of from $1\times10^{8}$ to $1\times10^{16}$ Ωcm, preferably from $1\times10^{11}$ to $1\times10^{16}$ Ωcm, more preferably from $1\times10^{13}$ to $1\times10^{16}$ Ωcm. When the volume resistivity of the layer of the network structural body of the present invention is low, the layer itself of the network structural body serves as a starting point for discharge and hence abnormal discharge occurs in some cases. In such cases, the suppressing effect on the abnormal discharge of the present invention is not sufficiently obtained. It has been confirmed that setting the volume resistivity to $1\times10^{8}$ Ωcm or more exhibits the suppressing effect on the abnormal discharge. It should be noted that 0.1 to 5 parts by mass of an ion conductive agent may be added to 100 parts by mass of the non-electroconductive fibers of the present invention as long as the condition of $1\times10^{8}$ Ωcm or more is satisfied. Further, setting the volume resistivity to $1\times10^{11}$ Ωcm or more can sufficiently suppress the discharge from the layer itself of the network structural body. The volume resistivity is more preferably set to $1\times10^{13}$ Ωcm or more because no discharge from the layer itself of the network structural body is observed and the suppressing effect on the abnormal discharge is obtained independent of the electrical resistance value of the electroconductive support. In addition, setting the volume resistivity to $1\times10^{16}$ Ωcm or less can suppress a discharge failure resulting from an increase in resistance of the layer itself of the network structural body.

It should be noted that the volume resistivity of each of the non-electroconductive fibers forming the layer of the network structural body can be measured by: recovering the layer of the network structural body from the electroconductive support with a pair of tweezers or the like; and bringing the cantilever of a scanning probe microscope (SPM) into contact with one of the fibers to sandwich the one fiber between the cantilever and an electroconductive substrate. In addition, the following may be adopted: the layer of the network structural body is similarly recovered from the electroconductive support, and is melted by heating or with a solvent to be turned into a sheet, and then the volume resistivity is measured.

[Method of Producing Layer of Network Structural Body]

Although a method of producing the layer of the network structural body according to the present invention is not particularly limited, for example, the following method is given: a method involving producing fibers from a raw material liquid for fibers according to, for example, an electrospinning method, a conjugate spinning method, a polymer blend spinning method, a melt-blow spinning method, or a flash spinning method, and laminating the produced fibers on the surface of the electroconductive support. It should be noted that all the fibers thus produced have sufficient lengths as compared with their fiber diameters.

It should be noted that the electrospinning method is the following method of producing fibers, A high voltage is applied, to a space between the raw material liquid in a syringe and a collector electrode, whereby the solution extruded from the syringe is provided with charge and scatters in an electric field to be turned into a narrow line, and the narrow line becomes a fiber and adheres to a collector.

Figure 2:
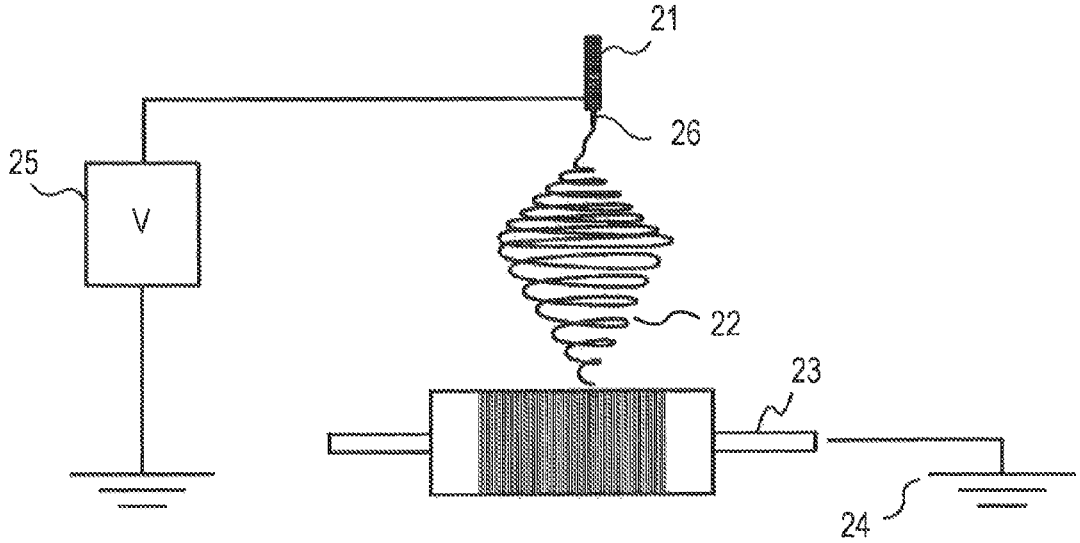
FIG. 2 is a schematic view of an electrospinning apparatus to be used in the production of the electroconductive member for electrophotography of the present invention.

Of the methods of producing the layer of the network structural body, the electrospinning method is preferred. The method of producing the layer of the network structural body based on the electrospinning method is described with reference to FIG. 2. As illustrated in FIG. 2, an electrospinning apparatus includes a high-voltage power source 25, a storage tank 21 for a raw material liquid, and a spinning nozzle 26, and a collector (electroconductive support) 23 attached to the apparatus is connected to a ground 24. The raw material liquid is extruded from the tank 21 to the spinning nozzle 26 at a constant speed. A voltage of from 1 to 50 kV is applied to the spinning nozzle 26, and when electrical attraction exceeds the surface tension of the raw material liquid, a jet 22 of the raw material liquid is injected toward the collector 23. A raw material liquid containing a solvent, a molten resin obtained by heating a resin material to its melting point or more, or the like can be used as the raw material liquid. When the raw material liquid is the raw material liquid containing the solvent, the solvent in the jet 22 gradually volatilizes, and the jet reduces in size to a nano level when arriving at the collector 23.

The network structural body according to the present invention can be obtained by controlling the fiber diameters of the fibers constituting the network structural body, and the mesh density and layer thickness of the network structural body. In addition, the fiber diameters of the fibers, and the mesh density and layer thickness of the network structural body can be controlled as described below.

First, the fiber diameters of the fibers can be mainly controlled by the solid content concentration of a material therefor, and reducing the solid content concentration can reduce their fiber diameters. As another means, the diameters can be reduced by increasing the applied voltage upon spinning, or by reducing the volume of the jet 22 and increasing the electrical attraction. In addition, the mesh density can be mainly controlled by the applied voltage. Specifically, when the applied voltage is increased, the electrical attraction is increased and hence the density can be increased. The density can be increased by lengthening a spinning time or increasing the speed at which the jet is ejected in addition to the applied voltage. Further, the thickness of the layer of the network structural body is proportional to the spinning time. Accordingly, the layer thickness of the network structural body can be increased by lengthening the spinning time.

In the present invention, the electroconductive support of the present invention is used as the collector (FIG. 2), and as a result, an electroconductive member in which the layer of the network structural body is formed on the outer peripheral surface of the electroconductive support can be directly produced. In this case, the layer of the network structural body becomes seamless. A seam may be produced depending on the method of producing the layer of the network structural body. For example, the following method causes a seam; a film of the network structural body is produced first and then the electroconductive support is covered with the film. An image failure may occur in a seam portion because the layer thickness of the seam portion is larger than that of any other site. Accordingly, the layer of the network structural body of the electroconductive member of the present invention is preferably seamless.

It should be noted that an approach to producing the raw material liquid for the electrospinning is not particularly limited and a conventionally known method can be appropriately employed. Here, the kind of a solvent to be incorporated and the concentration of the solution are not particularly limited, and only need to be conditions optimum for the electrospinning.

In addition, a conventionally known approach can be appropriately employed for the lamination of the electroconductive support and the layer of the network structural body; for example, the support and the layer may be directly laminated, or may be laminated and joined with an adhesive (pressure-sensitive adhesive). In this case, adhesiveness between the electroconductive support and the layer of the network structural body can be easily improved, and hence an electroconductive member additionally excellent in durability is obtained.

<Rigid Structural Body>

The effects of the present invention are expressed by the presence of the layer of the network structural body according to the present invention. In other words, when the structure of the network structural body changes, its discharge characteristic may also change. Therefore, particularly when the network structural body is intended for long-term use, a change in structure of the network structural body is preferably suppressed by introducing a rigid structural body for protecting the layer of the network structural body (surface layer) to reduce friction and abrasion between the surface of a photosensitive drum and the layer of the network structural body. Here, the rigid structural body refers to such a rigid structural body that the amount of the deformation of the structural body caused by its abutment with the photosensitive drum is 1 μm or less.

A method of providing the rigid structural body is not limited as long as the effects of the present invention are not impaired, and for example, a method involving introducing a separation member into the electroconductive member is given. The separation member is not limited as long as the member can separate the photosensitive drum (body to be charged) and the layer of the network structural body, and does not impair the effects of the present invention, and examples thereof include a ring and a spacer.

When the electroconductive member has a roller shape, one example of a method of introducing the separation member is a method involving introducing a ring having an outer diameter larger than that of the electroconductive member, and having such hardness as to be capable of maintaining a gap between the photosensitive drum and the electroconductive member. In addition, when the electroconductive member has a blade shape, another example of the method of introducing the separation member is a method involving introducing a spacer capable of separating the layer of the network structural body and the photosensitive drum so that friction or abrasion between both the layer and the drum may not occur.

A material constituting the separation member is not limited as long as the effects of the present invention are not impaired, and a known non-electroconductive material may be appropriately used for preventing electrification through the separation member. Examples thereof include: polymer materials excellent in sliding properties such as a polyacetal resin, a high-molecular weight polyethylene resin, and a nylon resin; and metal oxide materials such as titanium oxide and aluminum oxide.

The method of introducing the separation member is not limited as long as the effects of the present invention are not impaired, and for example, the member may be placed in an end portion in the longitudinal direction of the electroconductive support.

Figure 7:
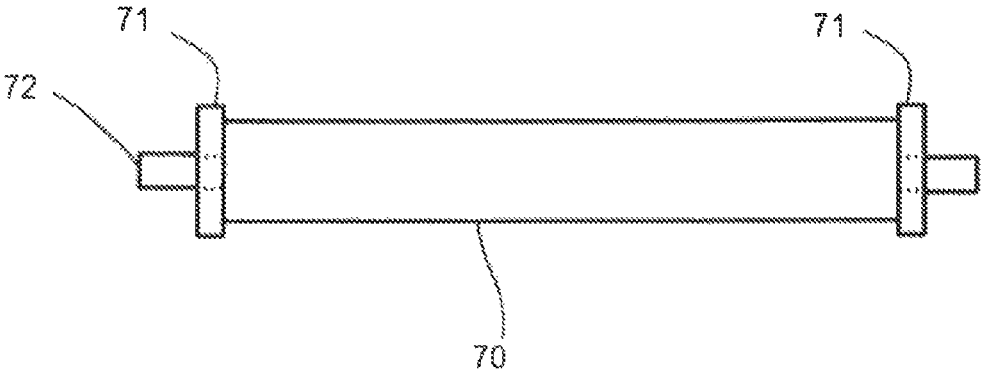
FIG. 7 is a schematic construction view illustrating an example (roller shape) of the case where the electroconductive member according to the present invention includes a separation member.

FIG. 7 illustrates an example (roller shape) of the electroconductive member in the case where the separation member is introduced. In FIG. 7, reference numeral 70 represents the electroconductive member, reference numeral 71 represents the separation member, and reference numeral 72 represents an electroconductive mandrel.

<Process Cartridge>

Figure 3:
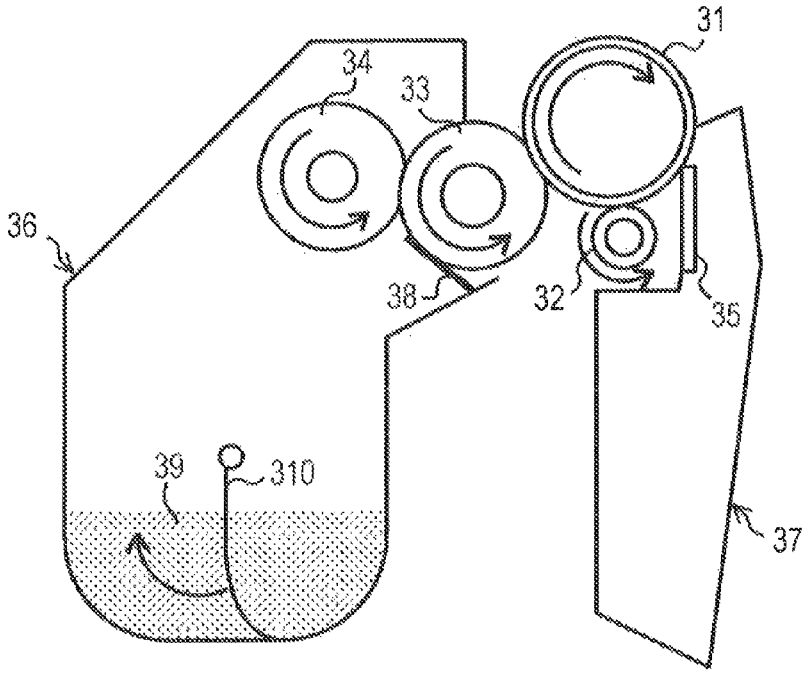
FIG. 3 is a view illustrating an example of a process cartridge according to the present invention.

A process cartridge according to the present invention is a process cartridge including the electroconductive member according to the present invention and being detachably mountable to the main body of an electrophotographic apparatus. FIG. 3 illustrates an example of the process cartridge for electrophotography according to the present invention. The process cartridge includes a developing device and a charging device. The developing device is obtained by integrating at least a developing roller 33 and a toner container 36, and may include, as necessary, a toner-supplying roller 34, a toner 39, a developing blade 38, and a stirring blade 310. The charging device is obtained by integrating at least a photosensitive drum 31, a cleaning blade 35, and a charging roller 32, and may further include a waste toner container 37. A voltage is applied to each of the charging roller 32, the developing roller 33, the toner-supplying roller 34, and the developing blade 38.

<Electrophotographic Apparatus>

Figure 4:
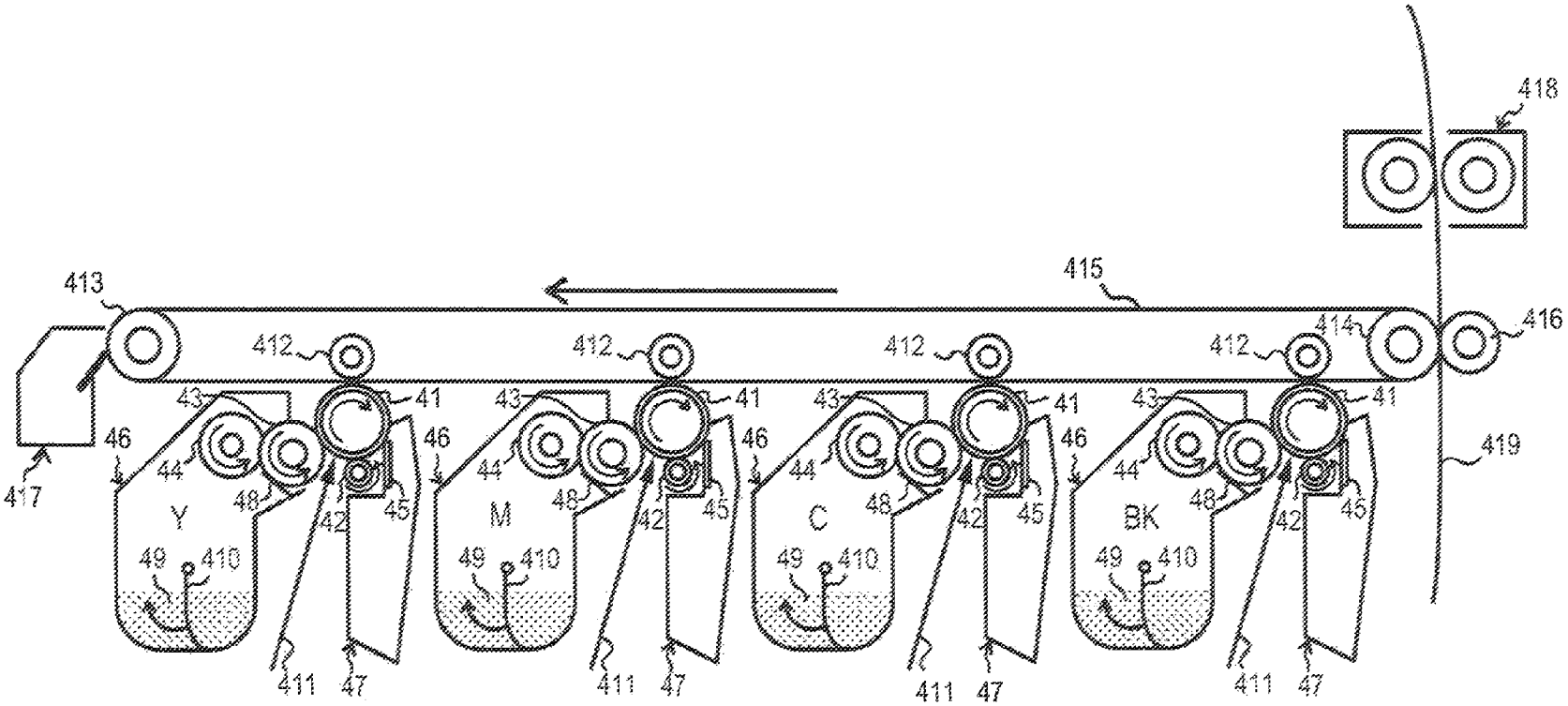
FIG. 4 is a view illustrating an example of an electrophotographic apparatus according to the present invention.

An electrophotographic apparatus according to the present invention is an electrophotographic apparatus comprising the electroconductive member according to the present invention, FIG. 4 illustrates an example of the electrophotographic apparatus according to the present invention. The electrophotographic apparatus is, for example, the following color image-forming apparatus. The process cartridge illustrated in FIG. 3 is provided for each of toners of respective colors, i.e., black, magenta, yellow, and cyan colors, and the process cartridge is detachably mountable to the apparatus.

A photosensitive drum 41 rotates in a direction indicated by an arrow and is uniformly charged by a charging roller 42 to which a voltage has been applied from a charging bias power source, and an electrostatic latent image is formed on its surface by exposure light 411. Meanwhile, a toner 49 accommodated in a toner container 46 is supplied to a toner-supplying roller 44 by a stirring blade 410 and conveyed onto a developing roller 43. Then, the surface of the developing roller 43 is uniformly coated with the toner 49 by a developing blade 48 placed to be in contact with the developing roller 43, and charge is imparted to the toner 49 by tribe-electric charging. The toner 49 conveyed by the developing roller 43 placed to be in contact with the photosensitive drum 41 is applied to the electrostatic latent image to develop the image, which is visualized as a toner image. The visualized toner image on the photosensitive member is transferred onto an intermediate transfer belt 415, which is supported and driven by a tension roller 413 and an intermediate transfer belt-driving roller 414, by a primary transfer roller 412 to which a voltage has been applied by a primary transfer bias power source. The toner images of the respective colors are sequentially superimposed to form a color image on the intermediate transfer belt.

A transfer material 419 is fed into the apparatus by a sheet-feeding roller, and is then conveyed into a gap between the intermediate transfer belt 415 and a secondary transfer roller 416. A voltage is applied from a secondary transfer bias power source to the secondary transfer roller 416, and then the roller transfers the color image on the intermediate transfer belt 415 onto the transfer material 419. The transfer material 419 onto which the color image has been transferred is subjected to fixing treatment by a fixing unit 418 and then discharged to the outside of the apparatus. Thus, a printing operation is completed.

Meanwhile, the toner remaining on the photosensitive drum without being transferred is scraped off the surface of the photosensitive drum by a cleaning blade 45 and stored in a waste toner-storing container 47. The photosensitive drum 41 that has been cleaned repeats the foregoing process. The toner remaining on the primary transfer belt (intermediate transfer belt) without being transferred is also scraped off by a cleaning device 417.

EXAMPLES

Example 1

1. Preparation of Unvulcanized Rubber Composition

An A-kneading rubber composition was obtained by mixing respective materials whose kinds and amounts were shown in Table 1 below with a pressure kneader. Further, respective materials whose kinds and amounts were shown in Table 2 below were mixed info 166 parts by mass of the A-kneading rubber composition with an open roll. Thus, an unvulcanized rubber composition was prepared.

TABLE 1

| | Material | Blending amount (part(s) by mass) |
|---|---|---|
| Raw material rubber | NBR (trade name: Nipol DN219, manufactured by ZEON CORPORATION) | 100 |
| Electroconductive agent | Carbon black (trade name: TOKABLACK #7360SB, manufactured by TOKAI CARBON CO., LTD.) | 40 |
| Filler | Calcium carbonate (trade name: Nanox #30, manufactured by MARUO CALCIUM CO., LTD.) | 20 |
| Vulcanization accelerating aid | Zinc oxide | 5 |
| Processing aid | Stearic acid | 1 |

TABLE 2

| | Material | Blending amount (part(s) by mass) |
|---|---|---|
| Crosslinking agent | Sulfur | 1.2 |
| Vulcanization accelerator | Tetrabenzyl thiuram disulfide (trade name: TBZTD, manufactured by SANSHIN CHEMICAL INDUSTRY CO., LTD.) | 4.5 |

2. Production of Electroconductive Support

The following electroconductive roller was produced, as the electroconductive support according to the present invention. Prepared was a round bar having a total length, of 252 mm and an outer diameter of 6 mm obtained by subjecting the surface of free-cutting steel to electroless nickel plating treatment. Next, an adhesive was applied over the entire periphery of a 230-mm range excluding both end portions of the round bar each having a length of 11 mm. An electroconductive, hot-melt type adhesive was used as the adhesive. In addition, a roll coater was used in the application. In this example, the round bar to which the adhesive had been applied was used as an electroconductive mandrel.

Next, a crosshead extruder having a mechanism for supplying the electroconductive mandrel and a mechanism for discharging an unvulcanized rubber roller was prepared. A die having an inner diameter of 12.5 mm was attached to a crosshead, the temperatures of the extruder and the crosshead were adjusted to 80° C., and the speed at which the electroconductive mandrel was conveyed was adjusted to 60 mm/sec. Under the conditions, the unvulcanized rubber composition was supplied from the extruder, and then the unvulcanized rubber composition was formed into an elastic layer on the outer peripheral surface of the electroconductive mandrel in the crosshead to provide an unvulcanized rubber roller. Next, the unvulcanized rubber roller was loaded into a hot-air vulcanization furnace at 170° C. and heated for 60 minutes to provide an unground electroconductive roller. After that, the end portions of the elastic layer were cut and removed. Finally, the surface of the elastic layer was ground with sharpening wheels. Thus, an electroconductive roller having a diameter at a position distant from its central portion toward each of both end portions by 90 mm of 8.4 mm and a diameter at the central portion of 8.5 mm was obtained.

3. Preparation of Application Liquid for Layer of Network Structural Body 2.5 Grams of dimethylformamide (DMF) were added to 7.5 g of a polyamide imide solution obtained by dissolving polyamide imide (PAI) in a mixed solvent of methylpyrrolidone (MNP) and xylene (manufactured by Toyo Boseki: VYLOMAX HR-13NX, solid content concentration; 30 mass %) to adjust the solid content to 22.5 mass %, Thus, an application liquid 1 was prepared.

4. Production of Electroconductive Member

Next, the application liquid 1 was injected by an electrospinning method, and the resultant fine fiber was directly wound around the electroconductive roller as the electroconductive support attached as a collector. Thus, an electroconductive member according to the present invention having the layer of a network structural body on the outer peripheral surface of the electroconductive support was produced.

That is, first, the electroconductive roller was installed as the collector of an electrospinning apparatus (manufactured by MECC Co., Ltd.). Next, the application liquid 1 was filled, into a tank. Then, the application liquid 1 was injected toward the electroconductive roller by moving a spinning nozzle left and right at 50 mm/s while applying a voltage of 20 kV to the nozzle. At that time, the electroconductive roller as the collector was rotated at 1,000 rpm. The injection of the application liquid 1 for 20 seconds provided the electroconductive member having the layer of the network structural body. It should be noted that in Table 5, the number of revolutions (rpm) of the collector is represented by "ES revolution number (rpm)" and the time period for which the application liquid is injected is represented by "ES treatment time (sec)." An electroconductive member 1 of Example 1 of the present invention was produced by the foregoing approach.

5. Evaluation for Characteristics

Next, the resultant electroconductive member 1 was subjected to the following evaluation tests. Table 5 shows the results of the evaluations.

5-1, Measurement of Fiber Diameters of Non-electroconductive Fibers

A scanning electron microscope (SEM) was used in the measurement of the fiber diameters of non-electroconductive fibers forming the layer of the network structural body (the observation was performed with an S-4800 manufactured by Hitachi High-Technologies Corporation at a magnification of 2,000). First, the electroconductive member 1 whose electroconductive support had a length of 230 mm was divided into 5 equal parts in its longitudinal direction. 0.05 Gram of the layer of the network structural body was stripped from each of the divided electroconductive members, and platinum was deposited from the vapor onto the surface of the layer of the network structural body. Next, the 5 layers of the network structural body onto which platinum had been deposited from the vapor (sample pieces S1 to S5) were each embedded in an epoxy resin and a cross section was caused to appear with a microtome, followed by the observation with the SEM.

At the time of the observation of the sample pieces S1 to S5 with the SEM, 10 fibers having cross-sectional shapes close to a circular shape were arbitrarily selected for each sample, and the diameters of the respective fibers were measured. The average of the diameters of a total of 50 fibers thus measured was defined as the average fiber diameter d. The average of the diameters of 5 fibers having 5 largest diameters among the 50 measured fibers was defined as the average fiber diameter $d^{10}$ of the top 10%. In addition, a standard deviation was determined from the diameters of the 50 fibers.

5-2. Measurement of Volume Resistivity of Non-Electroconductive Fiber

With regard to a method of measuring the volume resistivity of each of the fibers forming the layer of the network structural body, measurement was performed with a scanning probe microscope (SPM) (Q-Scope 250 manufactured by Quesant Instrument Corporation) according to a contact mode, First, the layer of the network structural body was recovered from the electroconductive member 1 with a pair of tweezers, and the recovered layer of the network structural body was placed on a metal plate made of stainless steel. Next, one fiber in direct contact with the plate made of stainless steel was selected, the cantilever of the SPM was brought into contact with the one fiber, a voltage of 50 V was applied to the cantilever, and a current value was measured. Next, the measured value was converted into a volume resistivity by using the average fiber diameter d determined by the method described in the section [5-1] and the contact area of the cantilever. The foregoing measurement was performed at 5 arbitrary sites and the average of the 5 measured values was defined as the volume resistivity of the non-electroconductive fiber.

5-3. Mesh-to-Mesh Distance of Network Structural Body

The mesh-to-mesh distance of the layer of the network structural body was evaluated by the following method. The electroconductive member 1 was observed with a laser microscope (LSM5 PASCAL manufactured by Carl Zeiss) from a direction perpendicular to the outer surface of the layer of the network structural body. At the time of the observation with the laser microscope, 100 square regions each having the following size were arbitrarily selected, and whether part of the fibers were observed was confirmed for each square region. It should be noted that the mesh-to-mesh distance of the layer of the network structural body was evaluated by the following criteria.

A: Part of the fibers are observed in each of all the square regions (100 regions) having one side length of 25 μm.
B: Part of the fibers are observed in each of all the square regions (100 regions) having one side length of 100 μm.
C: Part of the fibers are observed in each of all the square regions (100 regions) having one side length of 200 μm.
D: In some of the square regions (100 regions) having one side length of 200 μm, the fibers are not observed.

5-4. Average Thickness $t^1$ of Layer of Network Structural Body

The average thickness of the layer of the network structural body was evaluated by the following method. First, the electroconductive member 1 was divided into 5 equal parts in its longitudinal direction. A section of a parallelepiped shape having the following size was cut out of each of the divided electroconductive members with a razor: the section was 250 μm square in the outer surface of the layer of the network structural body, and had a length of 700 μm including the rubber roller as the electroconductive support in the thickness direction of the layer of the network structural body. Thus, sample pieces T1 to T5 were obtained. Next, the sample pieces T1 to T5 were each subjected to three-dimensional reconstruction with an X-ray CT inspector (trade name: TOHKEN-SkyScan2011 (radiation source: TX-300), manufactured by MARS TOHKEN X-RAY INSPECTION Co., Ltd.). The directions of the resultant three-dimensional image parallel and perpendicular to the outer surface of the electroconductive support were defined as an xy plane and a z-axis, respectively, and two-dimensional slice images (parallel to the xy plane) were cut out of the image at an interval of 1 μm with respect to the z-axis. Next, the resultant slice images were each binarized, and a fiber portion and a pore portion were distinguished from each other. The ratio of the fiber portion in each of the binarized slice images was digitized, and the point at which the ratio of the fiber portion (area of fiber portion/(area of fiber portion+area of pore portion)×100(%))) became 2% or less upon observation of a numerical value from the electroconductive support toward the outer surface (thickness direction) was defined as the outermost surface portion of the layer of the network structural, body. The thickness of the layer of the network structural body was measured by the foregoing method.

The foregoing operations were performed at 5 arbitrary sites for each of the sample pieces T1 to T5, and the average of the resultant layer thicknesses at 25 sites was defined as the average thickness $t^1$ of the layer of the network structural body.

5-5. Average Thickness $t^2$ of Layer of Network Structural Body in Contact Portion The average thickness $t^2$ of the contact portion of the layer of the network structural body was evaluated by the following method. First, the electroconductive member 1 was incorporated as a charging roller into a cartridge of a laser printer of an electrophotographic system (trade name; Laserjet CP4525dn, manufactured by Hewlett-Packard Company), and was left to stand under an environment having a temperature of 23° C. and a relative humidity of 50% for 3 days. After that, fibers were stripped from the layer of the network structural body present in a contact portion of a photosensitive drum and the charging roller with a pair of tweezers. The gap distance of a gap between the photosensitive drum and the charging roller produced as a result, of the stripping was measured with a rubber roller gap inspection machine (GM1000 manufactured by OPTRON). The measurement was performed at a total of 25 sites obtained by: dividing the electroconductive member 1 into 5 equal parts in its longitudinal direction; and selecting 5 arbitrary sites in each of the resultant 5 regions. The average of the gap distances at the 25 sites was defined as the average thickness $t^2$.

5-6. Measurement of Area Ratio by Voronoi Tessellation

A section having the following size was cut out of the surface layer of the electroconductive member 1 with a razor: the section had a length of 1 mm in the x-axis direction, a length of 0.5 mm in the y-axis direction, and a depth of 700 μm including the rubber roller as the electroconductive support in the z-axis direction. Next, the section was subjected to three-dimensional reconstruction with an X-ray CT inspector (trade name; TOHKEN-SkyScan2011 (radiation source; TX-300), manufactured by MARS TOHKEN X-RAY INSPECTION Co., Ltd.). A group of 20 two-dimensional slice images (parallel to the yz plane) was cut out of the resultant three-dimensional image at an interval of 3 μm with respect to the x-axis.

Figure 5:
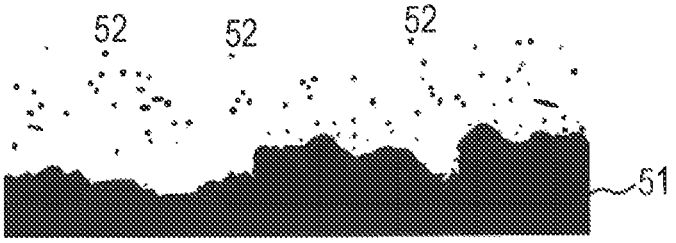
FIG. 5 illustrates an example of a binarized image of a cross section of a fiber constituting the layer of a network structural body.

First, one image was selected from the group of slice images, its brightness and contrast were changed with image processing software Imageproplus ver. 6.3 (manufactured by Media Cybernetics) to the extent that the size of a fiber cross-sectional image did not change, and binarization processing was performed with the software so that a fiber cross-sectional image group and the electroconductive support were represented in black. Thus, a binarized image was obtained. FIG. 5 illustrates an example of the actual binarized image, and reference numeral 51 represents the electroconductive support and reference numeral 52 represents the fiber cross-sectional image group.

Next, only a cross-sectional image of the fibers was cut out of the binarized image with a paint application included with Windows (trademark) 7 manufactured by Microsoft. Thus, a fiber cross-sectional image (yz cross section) was obtained. Further, two straight lines included in two lines of intersection of two planes perpendicular to the z-axis and passing the centers of gravity of fiber cross sections placed at the uppermost end and lowermost end in the fiber cross sections (yz cross sections), and the fiber cross sections (yz cross sections), the two straight lines having the same length as the width of the fiber cross-sectional image, were drawn so as to be included in the fiber cross-sectional image. Here, the uppermost end and lowermost end in the fiber cross-sectional image are as follows: in the cross-sectional image before the cutout of only the cross-sectional image of the fibers, the fiber cross section whose shortest distance from the electroconductive support is largest in the fiber cross-sectional image group is the uppermost end, and the fiber cross section whose shortest distance therefrom is smallest is the lowermost end. In addition, a rectangle obtained by connecting both ends of the two straight lines with a straight line was defined as the occupied region of the surface layer.

Figure 6:
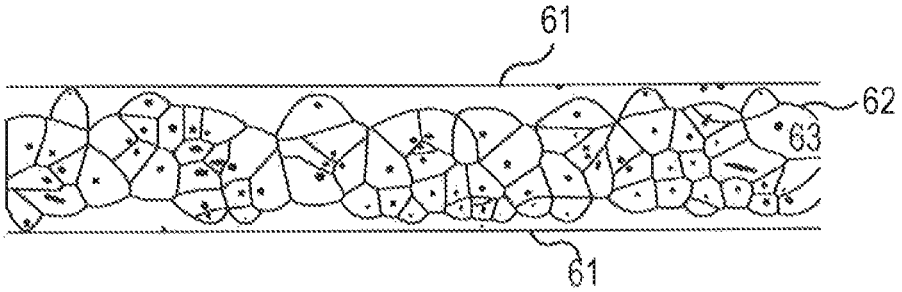
FIG. 6 illustrates an example of a fiber sectional image after Voronoi tessellation.

Next, Voronoi tessellation was performed with the image processing software in the occupied region in the yz cross section by pruning processing using the group of the fiber cross sections (yz cross sections) as generating points. FIG. 6 illustrates an example of a figure after the performance of the Voronoi tessellation. In FIG. 6, reference numeral 61 represents each of the two straight lines parallel to each other defining the occupied region, reference numeral 62 represents the borderline of a Voronoi polygon, and reference numeral 63 represents a fiber cross section group. Each of areas of resultant Voronoi polygons is defined as $S_1$. And each of cross-sectional areas in the cross section of the fibers as the generating points of the respective Voronoi polygons is defined as $S_2$. Then, the area ratio k of the area $S_1$ to the cross-sectional area $S_2$ was calculated, and the arithmetic average $k^{U10}$ of the top 10% of the area ratios k was determined. In addition, the average of the area ratios k was determined.

6. Image Evaluation

Next, the electroconductive member 1 was subjected to the following evaluations in order for its stabilizing effect on discharge to be confirmed. Table 5 shows the results of the evaluations.

An electrophotographic laser printer (trade name: Laserjet CP4525dn, manufactured by Hewlett-Packard Company) was prepared as an electrophotographic apparatus. It should be noted that in order for the electroconductive member to be placed under an additionally severe evaluation environment, the laser printer was reconstructed so that the number of sheets to be output per unit time became 50 sheets of A4 size paper per minute, which was larger than the original number of sheets to be output. At that time, the speed at which a recording medium was output was set to 300 mm/second and an image resolution was set to 1,200 dpi. Next, the electroconductive member 1 was mounted as a charging roller onto a toner cartridge dedicated for the laser printer. The toner cartridge was mounted onto the laser printer and image evaluations were performed. Each of all the image evaluations was performed under an environment having a temperature of 15° C. and a relative humidity of 10%, and was performed by outputting a halftone image for an evaluation (such an image that horizontal lines each having a width of 1 dot were drawn at an interval of 2 dots in a direction perpendicular to the rotation direction of a photosensitive member). The resultant halftone image was evaluated by the following criteria.

Evaluation for Horizontal Streak-Like Image Defect

A; No horizontal streak-like image defect is present.
B; A slight horizontal streak-like white line is partially observed.
C; A slight horizontal streak-like white line is observed in the entire surface.
D: A significant horizontal streak-like white line is observed and is conspicuous.

Evaluation for Blank Dot-like Image Defect

A: No blank dot-like image defect, is present.
B: A slight blank dot-like image defect is partially observed.
C: A slight blank dot-like image defect is entirely observed.
D: A significant blank dot-like image defect is observed and is conspicuous.

Next, an endurance test was performed for confirming a suppressing effect of the electroconductive member of the present invention on an image with a horizontal streak in the final stage of the endurance test. The endurance test was performed by outputting 10,000 images according to the so-called intermittent mode in which the rotation of the photosensitive drum was completely stopped for about 3 seconds every time 2 images were output. In addition, such an image that an alphabetical character "E" having a size of 4 points was printed so as to have a coverage of 4% with respect to the area of A4 size paper (E-character image) was used as an output, image in the endurance test. After the E-character image had been output, on 10,000 sheets, the halftone image for an evaluation was output and the resultant halftone image was evaluated by the same criteria as those in the section [Evaluation for Horizontal Streak-like Image Defect].

Examples 2 to 31

Electroconductive members were each produced in the same manner as in Example 1 except that; the fiber material used in the preparation of the application liquid for the layer of the network structural body was changed to a material shown in Table 4; and the conditions under which the application liquid for the layer of the network structural body was applied were changed as shown in Tables 5 to 8. Then, the members were similarly evaluated. Tables 5 to 8 show the results of the evaluations.

Examples 32 to 34

Electroconductive members were each produced in the same manner as in Example 5 except that: an electroconductive elastic roller produced from an unvulcanized rubber composition obtained by mixing materials shown in Table 3 below with an open roll was used; and the injection time of the application liquid was changed, to an injection time shown in Table 8. Then, the members were similarly evaluated. Table 8 shows the results of the evaluations.

TABLE 3

| Material | Blending amount (part(s) by mass) |
|---|---|
| Epichlorohydrin-ethylene oxide-allyl glycidyl ether terpolymer (GECO) (trade name: EPICHLOMER CG-102, manufactured by DAISO CO., LTD.) | 100 |
| Zinc oxide (ZINC OXIDE #2 manufactured by SEIDO CHEMICAL INDUSTRY CO., LTD.) | 5 |
| Calcium carbonate (trade name: SILVER W, manufactured by SHIRAISHI CALCIUM KAISHA, LTD.) | 35 |
| Carbon black (trade name: SEAST SO, manufactured by TOKAI CARBON CO., LTD.) | 0.5 |
| Stearic acid | 2 |
| Adipic acid ester (trade name: POLYCIZER W305ELS, manufactured by DIC CORPORATION) | 10 |
| Sulfur | 0.5 |
| Dipentamethylene thiuram tetrasulfide (trade name: NOCCELER TRA, manufactured by OUCHI SHINKO CHEMICAL INDUSTRIAL CO., LTD.) | 2 |
| Cetyltrimethylammonium bromide | 2 |

Example 35

A protective layer was formed on the electroconductive support produced in Example 32 according to the following method. Methyl isobutyl ketone was added to a caprclactone-modified acrylic polyol solution and the solid content was adjusted to 10 mass %. A mixed solution was prepared by placing 15 parts by mass of carbon black (HAF), 35 parts by mass of needle-like rutile-type titanium oxide fine particles, 0.1 part by mass of modified dimethyl silicone oil, and 80.14 parts by mass of a mixture containing butanone oxime blocked bodies of hexamethylene diisocyanate (HDI) and isophorone diisocyanate (IPDI) at 7:3 in 100 parts by mass of the acrylic polyol solution in terms of solid content. At this time, the mixture of the blocked HDI and the blocked IPDI was added so that the ratio of "NCO/OH=1.0" was satisfied.

Next, 210 g of the mixed solution and 200 g of glass beads having an average particle diameter of 0.8 mm as media were loaded into a 450-mL glass bottle and were mixed. The mixture was dispersed with a paint shaker dispersing machine for 24 hours. Thus, an application liquid P1 for forming a protective layer was obtained.

Application by a dipping method was performed by dipping an electroconductive roller produced in the same manner as in Example 32 in the application liquid with its longitudinal direction as a vertical direction. A dipping time was regulated to 9 seconds, and a dipping application pulling speed was regulated so that its initial speed became 20 mm/second and its final speed became 2 mm/second. In the range of from 20 mm/second to 2 mm/second, the speed was linearly changed with time. An applied product thus obtained was air-dried at normal temperature for 30 minutes, then dried in a hot air-circulating dryer set to 90° C. for 1 hour, and dried in a hot air-circulating dryer set to 160° C. for 1 hour. Thus, a protective layer was formed on the electroconductive roller. After that, an electroconductive member was produced by forming the layer of a network structural body on the outer periphery of the protective layer in the same manner as in Example 5, and was similarly evaluated. Table 8 shows the results of the evaluations.

Example 36

An electroconductive member was produced in the same manner as in Example 7 except that the round bar having applied thereto the adhesive of Example 1 was used as an electroconductive support, and the member was similarly evaluated. Table 8 shows the results of the evaluations.

Example 37

The application liquid P1 for forming a protective layer prepared in the same manner as in Example 35 was applied onto a sheet made of aluminum having a thickness of 200 μm by a dipping method under the same conditions as those of Example 35, and the coating film was cured. Thus, a blade-shaped electroconductive support in which a protective layer was formed on the sheet made of aluminum was produced. Next, a charging blade was produced by forming the layer of the network structural body of the present invention in the same manner as in Example 7 except that, the blade-shaped electroconductive support was placed on the collector portion of FIG. 2.

Next, the charging blade was attached instead of a charging roller to an electrophotographic laser printer reconstructed in the same manner as in Example 1, and was placed to abut therewith in a forward direction with respect to the rotation direction of a photosensitive drum. It should be noted that an angle θ formed between a contact point at the abutting point of the charging blade with respect to the photosensitive drum and the charging blade was set to 20° in terms of chargeability, and the abutting pressure of the charging blade with respect to the photosensitive drum was initially set to 20 g/cm (linear pressure). Image evaluations were performed under the same conditions as those in the case of the charging roller. Table 8 shows the results of the evaluations.

Example 38

An electroconductive member was produced in the same manner as in Example 3 except that a ring made of polyoxymethylene having an outer diameter of 8.6 mm, an inner diameter of 6.0 mm, and a width of 2 mm was attached to an outer side in the longitudinal direction of the elastic layer of the electroconductive member 1, and was bonded thereto with an adhesive so as to rotate following a mandrel. Then, the member was similarly evaluated. Table 8 shows the results of the evaluations. It should be noted that in this example, a separation member is introduced and hence the separation member is in contact with a photosensitive drum, and a gap of about 50 μm on average is formed between the electroconductive member and the photosensitive drum.

TABLE 4

| | Fiber material | Product name | Solvent | Solid content concentration (mass %) |
|---|---|---|---|---|
| Application liquid 1 | PAI | "VYLOMAX HR-13NX" (trade name; manufactured by TOYOBO CO., LTD.) | DMF | 22.5 |
| Application liquid 2 | | | | 17 |
| Application liquid 3 | | | | 20 |
| Application liquid 4 | | | | 26 |
| Application liquid 5 | | | | 30 |
| Application liquid 6 | PVDF-HFP | "KYNAR 2851" (trade name; manufactured by ARKEMA) | DMAc | 1.9 |
| Application liquid 7 | | | | 1.5 |
| Application liquid 8 | | | | 2.8 |
| Application liquid 9 | PEO | Polyethylene oxide (manufactured by Tokyo Chemical Industry Co., Ltd., molecular weight: 900,000) | Water | 6 |
| Application liquid 10 | Nylon 6 | "Nylon 6" (manufactured by Tokyo Chemical Industry Co., Ltd., molecular weight: 35,000) | Formic acid | 20 |
| Application liquid 11 | PES | "ARON MELT PES375S40" (trade name; manufactured by TOAGOSEI CO., LTD.) | DMAc | 37.4 |
| Application liquid 12 | $SiO_2$ | "FLECELLA" (trade name; manufactured by Panasonic Electric Works Co., Ltd.) | IPA | 34 |

TABLE 4-continued

| | Fiber material | Product name | Solvent | Solid content concentration (mass %) |
|---|---|---|---|---|
| Application liquid 13 | PAI | "VYLOMAX HR-13NX" (trade name; manufactured by TOYOBO CO., LTD.) | DMF | 40 |

PAI: polyamide imide
PVDF-HPF: polyvinylidene fluoride-hexafluoropropylene copolymer
PEO: polyethylene oxide
PES: polyether sulfone
DMF: dimethylformamide
DMAc: dimethylacetamide
IPA: isopropyl alcohol

TABLE 5

| | Example 1 | Example 2 | Example 3 | Example 4 | Example 5 |
|---|---|---|---|---|---|
| Electroconductive support | | | | | |
| Mandrel | ○ | ○ | ○ | ○ | ○ |
| Electroconductive elastic layer | NBR | NBR | NBR | NBR | NBR |
| Protective layer | — | — | — | — | — |
| Protective layer thickness (μm) | — | — | — | — | — |
| Layer of network structural body | | | | | |
| Application liquid | Application liquid 1 | Application liquid 1 | Application liquid 1 | Application liquid 1 | Application liquid 1 |
| ES revolution number (rpm) | 1,000 | 1,000 | 1,000 | 1,000 | 1,000 |
| ES treatment time (seconds) | 20 | 30 | 60 | 120 | 180 |
| Average fiber diameter (μm) | 0.80 | 0.80 | 0.81 | 0.76 | 0.78 |
| Average fiber diameter of top 10% (μm) | 1.25 | 1.47 | 1.26 | 1.30 | 1.24 |
| Standard deviation of fiber diameter (%) | 28 | 34 | 29 | 30 | 27 |
| Average layer thickness (μm) | 21 | 29 | 48 | 66 | 81 |
| Average layer thickness of contact portion (μm) | 1.4 | 2.2 | 3.1 | 3.8 | 4.6 |
| Mesh-to-mesh distance | C | B | A | A | A |
| $k^{V10}$ | 152.1 | 120.3 | 91.6 | 73.3 | 75.1 |
| Volume resistivity (Ωcm) | $1 \times 10^{14}$ | $1 \times 10^{14}$ | $1 \times 10^{14}$ | $1 \times 10^{14}$ | $1 \times 10^{14}$ |
| Image evaluation | | | | | |
| Evaluation for horizontal streak-like image defect (initial stage) | A | A | A | A | A |
| Evaluation for horizontal streak-like image defect (after endurance) | C | C | B | B | A |
| Evalution for blank dot-like image defect | C | B | A | A | A |

| | Example 6 | Example 7 | Example 8 | Example 9 | Example 10 |
|---|---|---|---|---|---|
| Electroconductive support | | | | | |
| Mandrel | ○ | ○ | ○ | ○ | ○ |
| Electroconductive elastic layer | NBR | NBR | NBR | NBR | NBR |
| Protective layer | — | — | — | — | — |
| Protective layer thickness (μm) | — | — | — | — | — |
| Layer of network structural body | | | | | |
| Application liquid | Application liquid 1 | Application liquid 1 | Application liquid 2 | Application liquid 3 | Application liquid 4 |
| ES revolution number (rpm) | 1,000 | 1,000 | 1,000 | 1,000 | 1,000 |
| ES treatment time (seconds) | 300 | 450 | 240 | 210 | 120 |
| Average fiber diameter (μm) | 0.80 | 0.75 | 0.31 | 0.53 | 2.50 |
| Average fiber diameter of top 10% (μm) | 1.32 | 1.35 | 1.47 | 0.77 | 5.50 |

TABLE 5-continued

| | | | | | |
|---|---|---|---|---|---|
| Standard deviation of fiber diameter (%) | 30 | 32 | 29 | 30 | 50 |
| Average layer thickness (μm) | 95 | 121 | 74 | 82 | 80 |
| Average layer thickness of contact portion (μm) | 7.3 | 12.1 | 1.2 | 3.2 | 25.0 |
| Mesh-to-mesh distance | A | A | A | A | A |
| $k^{V10}$ | 77.1 | 69.9 | 81.5 | 79.6 | 68.4 |
| Volume resistivity (Ωcm) | $1 \times 10^{14}$ | $1 \times 10^{14}$ | $1 \times 10^{14}$ | $1 \times 10^{14}$ | $1 \times 10^{14}$ |
| Image evaluation | | | | | |
| Evaluation for horizontal streak-like image defect (initial stage) | B | C | A | A | A |
| Evaluation for horizontal streak-like image defect (after endurance) | B | A | B | B | B |
| Evalution for blank dot-like image defect | A | A | A | A | B |

TABLE 6

| | Example 11 | Example 12 | Example 13 | Example 14 | Example 15 |
|---|---|---|---|---|---|
| Electroconductive support | | | | | |
| Mandrel | ○ | ○ | ○ | ○ | ○ |
| Electroconductive elastic layer | NBR | NBR | NBR | NBR | NBR |
| Protective layer | — | — | — | — | — |
| Protective layer thickness (μm) | — | — | — | — | — |
| Layer of network structural body | | | | | |
| Application liquid | Application liquid 5 | Application liquid 2 | Application liquid 2 | Application liquid 3 | Application liquid 3 |
| ES revolution number (rpm) | 1,000 | 1,000 | 1,000 | 1,000 | 1,000 |
| ES treatment time (seconds) | 90 | 25 | 400 | 45 | 500 |
| Average fiber diameter (μm) | 5.98 | 0.33 | 0.32 | 0.55 | 0.51 |
| Average fiber diameter of top 10% (μm) | 14.0 | 0.48 | 0.51 | 0.72 | 0.87 |
| Standard deviation of fiber diameter (%) | 80 | 28 | 29 | 28 | 37 |
| Average layer thickness (μm) | 99 | 8 | 85 | 35 | 102 |
| Average layer thickness of contact portion (μm) | 8.8 | 1.0 | 3.3 | 1.9 | 6.3 |
| Mesh-to-mesh distance | B | C | A | A | A |
| $k^{V10}$ | 61.3 | 158.9 | 81.3 | 150.5 | 79.8 |
| Volume resistivity (Ωcm) | $1 \times 10^{14}$ | $1 \times 10^{14}$ | $1 \times 10^{14}$ | $1 \times 10^{14}$ | $1 \times 10^{14}$ |
| Image evaluation | | | | | |
| Evaluation for horizontal streak-like image defect (initial stage) | B | A | A | A | A |
| Evaluation for horizontal streak-like image defect (after endurance) | B | B | B | B | B |
| Evalution for blank dot-like image defect | B | C | A | A | A |

| | Example 16 | Example 17 | Example 18 | Example 19 | Example 20 |
|---|---|---|---|---|---|
| Electroconductive support | | | | | |
| Mandrel | ○ | ○ | ○ | ○ | ○ |
| Electroconductive elastic layer | NBR | NBR | NBR | NBR | NBR |
| Protective layer | — | — | — | — | — |
| Protective layer thickness (μm) | — | — | — | — | — |
| Layer of network structural body | | | | | |
| Application liquid | Application liquid 4 | Application liquid 4 | Application liquid 5 | Application liquid 5 | Application liquid 6 |

TABLE 6-continued

| | | | | | |
|---|---|---|---|---|---|
| ES revolution number (rpm) | 1,000 | 1,000 | 1,000 | 1,000 | 1,000 |
| ES treatment time (seconds) | 30 | 360 | 15 | 450 | 60 |
| Average fiber diameter (μm) | 2.47 | 2.52 | 5.85 | 5.98 | 0.77 |
| Average fiber diameter of top 10% (μm) | 4.4 | 4.8 | 13.4 | 14.7 | 1.31 |
| Standard deviation of fiber diameter (%) | 49 | 52 | 78 | 80 | 29 |
| Average layer thickness (μm) | 39 | 211 | 44 | 234 | 45 |
| Average layer thickness of contact portion (μm) | 18 | 47 | 24 | 63 | 3.0 |
| Mesh-to-mesh distance | B | A | C | C | A |
| $k^{V10}$ | 135.8 | 75.2 | 120.1 | 63.5 | 44.4 |
| Volume resistivity (Ωcm) | $1 \times 10^{14}$ | $1 \times 10^{14}$ | $1 \times 10^{14}$ | $1 \times 10^{14}$ | $5 \times 10^{15}$ |
| Image evaluation | | | | | |
| Evaluation for horizontal streak-like image defect (initial stage) | A | B | A | C | A |
| Evaluation for horizontal streak-like image defect (after endurance) | B | B | B | C | B |
| Evalution for blank dot-like image defect | C | C | C | C | A |

TABLE 7

| | Example 21 | Example 22 | Example 23 | Example 24 | Example 25 |
|---|---|---|---|---|---|
| Electroconductive support | | | | | |
| Mandrel | ○ | ○ | ○ | ○ | ○ |
| Electroconductive elastic layer | NBR | NBR | NBR | NBR | NBR |
| Protective layer | — | — | — | — | — |
| Protective layer thickness (μm) | — | — | — | — | — |
| Layer of network structural body | | | | | |
| Application liquid | Application liquid 6 | Application liquid 6 | Application liquid 6 | Application liquid 7 | Application liquid 8 |
| ES revolution number (rpm) | 1,000 | 1,000 | 1,000 | 1,000 | 1,000 |
| ES treatment time (seconds) | 180 | 300 | 450 | 210 | 120 |
| Average fiber diameter (μm) | 0.79 | 0.77 | 0.81 | 0.52 | 3.80 |
| Average fiber diameter of top 10% (μm) | 1.33 | 1.31 | 1.41 | 0.70 | 4.70 |
| Standard deviation of fiber diameter (%) | 28 | 28 | 30 | 29 | 28 |
| Average layer thickness (μm) | 79 | 98 | 112 | 82 | 79 |
| Average layer thickness of contact portion (μm) | 4.4 | 8.1 | 13.3 | 3.3 | 19.0 |
| Mesh-to-mesh distance | A | A | A | A | A |
| $k^{V10}$ | 73.5 | 71.1 | 70.5 | 79.4 | 69.1 |
| Volume resistivity (Ωcm) | $5 \times 10^{15}$ | $5 \times 10^{15}$ | $5 \times 10^{15}$ | $5 \times 10^{15}$ | $5 \times 10^{15}$ |
| Image evaluation | | | | | |
| Evaluation for horizontal streak-like image defect (initial stage) | A | C | C | A | A |
| Evaluation for horizontal streak-like image defect (after endurance) | B | C | C | B | B |
| Evalution for blank dot-like image defect | A | A | A | A | B |

| | Example 26 | Example 27 | Example 28 | Example 29 | Example 30 |
|---|---|---|---|---|---|
| Electroconductive support | | | | | |
| Mandrel | ○ | ○ | ○ | ○ | ○ |
| Electroconductive elastic layer | NBR | NBR | NBR | NBR | NBR |
| Protective layer | — | — | — | — | — |

TABLE 7-continued

| | | | | | |
|---|---|---|---|---|---|
| Protective layer thickness (μm) | — | — | — | — | — |
| Layer of network structural body | | | | | |
| Application liquid | Application liquid 9 | Application liquid 10 | Application liquid 11 | Application liquid 12 | Application liquid 1 |
| ES revolution number (rpm) | 1,000 | 1,000 | 1,000 | 1,000 | 1,000 |
| ES treatment time (seconds) | 200 | 180 | 180 | 180 | 180 |
| Average fiber diameter (μm) | 0.53 | 0.85 | 0.78 | 0.66 | 1.32 |
| Average fiber diameter of top 10% (μm) | 0.88 | 1.53 | 1.33 | 0.98 | 0.81 |
| Standard deviation of fiber diameter (%) | 42 | 33 | 29 | 25 | 29 |
| Average layer thickness (μm) | 81 | 82 | 83 | 81 | 83 |
| Average layer thickness of contact portion (μm) | 3.4 | 6.1 | 4.5 | 5.0 | 3.5 |
| Mesh-to-mesh distance | A | A | A | A | A |
| $k^{V10}$ | | | | | |
| Volume resistivity (Ωcm) | $2 \times 10^{8}$ | $1 \times 10^{12}$ | $5 \times 10^{14}$ | $2 \times 10^{13}$ | $1 \times 10^{14}$ |
| Image evaluation | | | | | |
| Evaluation for horizontal streak-like image defect (initial stage) | A | A | A | A | A |
| Evaluation for horizontal streak-like image defect (after endurance) | A | B | B | B | B |
| Evalution for blank dot-like image defect | B | A | A | A | A |

TABLE 8

| | Example 31 | Example 32 | Example 33 | Example 34 | Example 35 |
|---|---|---|---|---|---|
| Electroconductive support | | | | | |
| Mandrel | ○ | ○ | ○ | ○ | ○ |
| Electroconductive elastic layer | NBR | GECO | GECO | GECO | GECO |
| Protective layer | — | — | — | — | Urethane |
| Protective layer thickness (μm) | — | — | — | — | — |
| Layer of network structural body | | | | | |
| Application liquid | Application liquid 1 | Application liquid 1 | Application liquid 1 | Application liquid 1 | Application liquid 1 |
| ES revolution number (rpm) | 3,000 | 1,000 | 1,000 | 1,000 | 1,000 |
| ES treatment time (seconds) | 180 | 30 | 180 | 300 | 180 |
| Average fiber diameter (μm) | 0.79 | 0.80 | 0.81 | 0.77 | 0.82 |
| Average fiber diameter of top 10% (μm) | 1.29 | 1.33 | 1.28 | 1.30 | 1.25 |
| Standard deviation of fiber diameter (%) | 28 | 29 | 27 | 28 | 27 |
| Average layer thickness (μm) | 80 | 29 | 81 | 101 | 75 |
| Average layer thickness of contact portion (μm) | 4.3 | 4.5 | 4.5 | 4.4 | 4.2 |
| Mesh-to-mesh distance | A | A | A | A | A |
| $k^{V10}$ | 74.4 | 120.8 | 75.9 | 77.1 | 74.9 |
| Volume resistivity (Ωcm) | $1 \times 10^{14}$ | $1 \times 10^{14}$ | $1 \times 10^{14}$ | $1 \times 10^{14}$ | $1 \times 10^{14}$ |
| Image evaluation | | | | | |
| Evaluation for horizontal streak-like image defect (initial stage) | A | C | A | B | A |
| Evaluation for horizontal streak-like image defect (after endurance) | B | C | B | C | B |
| Evalution for blank dot-like image defect | A | A | A | A | A |

TABLE 8-continued

| | Example 36 | Example 37 | Example 38 |
|---|---|---|---|
| Electroconductive support | | | |
| Mandrel | ○ | Blade | ○ |
| Electroconductive elastic layer | — | — | NBR |
| Protective layer | — | Urethane | — |
| Protective layer thickness (μm) | — | — | — |
| Layer of network structural body | | | |
| Application liquid | Application liquid 1 | Application liquid 1 | Application liquid 2 |
| ES revolution number (rpm) | 1,000 | 1,000 | 1,000 |
| ES treatment time (seconds) | 450 | 450 | 60 |
| Average fiber diameter (μm) | 0.78 | 0.75 | 0.81 |
| Average fiber diameter of top 10% (μm) | 1.41 | 1.33 | 1.26 |
| Standard deviation of fiber diameter (%) | 31 | 29 | 29 |
| Average layer thickness (μm) | 122 | 118 | 48 |
| Average layer thickness of contact portion (μm) | 13.3 | 13.1 | 3.1 |
| Mesh-to-mesh distance | A | A | A |
| $k^{V10}$ | 70.3 | 68.9 | 90.9 |
| Volume resistivity (Ωcm) | $1 \times 10^{14}$ | $1 \times 10^{14}$ | $1 \times 10^{14}$ |
| Image evaluation | | | |
| Evaluation for horizontal streak-like image defect (initial stage) | B | C | A |
| Evaluation for horizontal streak-like image defect (after endurance) | C | C | A |
| Evalution for blank dot-like image defect | C | C | A |

Comparative Example 1

An electroconductive member was produced in the same manner as in Example 1 except that the treatment time of the electrospinning was changed to 10 seconds, and the member was evaluated in the same manner as in Example 1. In addition, an evaluation for a horizontal streak-like image defect after an endurance test was not performed because a blank dot-like image defect was detected in the initial image evaluation. It should be noted that the mesh-to-mesh distance of the layer of the network structural body of this comparative example does not satisfy the requirement of the present invention. Table 9 shows the results of the evaluations.

Comparative Example 2

An electroconductive member was produced in the same manner as in Example 1 except that an application liquid 13 obtained by concentrating the application liquid 1 prepared in the same manner as in Example 1 to change its resin solid content concentration to 40 mass % was used instead of the application liquid 1, and the member was evaluated in the same manner as in Example 1. In addition, an evaluation for a horizontal streak-like image defect after an endurance test, was not performed because a blank dot-like image defect, was detected in the initial image evaluation. It should be noted that the average fiber diameter of the top 10% of the fibers forming the network structural body of this comparative example does not satisfy the requirement of the present invention. Table 9 shows the results of the evaluations.

Comparative Example 3

An electroconductive member was produced by winding a commercial metal wire (copper wire having a diameter of 10 μm manufactured by ELEKTRISOLA) around the electroconductive roller produced in Example 1 to cover the surface of the electroconductive roller, and the member was evaluated in the same manner as in Example 1. In addition, an evaluation for a horizontal streak-like image defect after an endurance test was not performed because a blank dot-like image defect was detected in the initial image evaluation. It should be noted that the layer of the network structural body of this comparative example does not satisfy the requirement of the present invention because the layer is constituted of electroconductive fibers. Table 9 shows the results of the evaluations.

Comparative Example 4

An electroconductive member was produced by applying the application liquid 1 to the electroconductive roller produced in Example 1 through dipping treatment and drying the liquid under heat, and the member was evaluated in the same manner as in Example 1. In addition, an evaluation for a horizontal streak-like image defect after an endurance test was not performed because a blank dot-like image defect was detected in the initial image evaluation. It should be noted that the electroconductive member of this comparative example does not satisfy the requirement of the present invention because the member does not have any layer of a network structural body. Table 9 shows the results of the evaluations. It should be noted that the coating film obtained by the application of the application liquid 1 was represented as a protective layer in Table 9.

TABLE 9

| | Comparative Example 1 | Comparative Example 2 | Comparative Example 3 | Comparative Example 4 |
|---|---|---|---|---|
| Electroconductive support | | | | |
| Mandrel | ○ | ○ | ○ | ○ |
| Electroconductive elastic layer | NBR | NBR | NBR | NBR |
| Protective layer | — | — | — | Application liquid 1 |
| Protective layer thickness (μm) | — | — | — | 5.2 |
| Layer of network structural body | | | | |
| Application liquid | Application liquid 1 | Application liquid 13 | Application liquid 1 | — |
| ES revolution number (rpm) | 1,000 | 1,000 | — | — |
| ES treatment time (seconds) | 10 | 20 | — | — |
| Average fiber diameter (μm) | 0.78 | 8.94 | 11.2 | — |
| Average fiber diameter of top 10% (μm) | 1.31 | 18.6 | 11.7 | — |
| Standard deviation of fiber diameters (%) | 30 | 88 | 12 | — |
| Average layer thickness (μm) | 5.1 | 315 | 68 | — |
| Average layer thickness of contact portion (μm) | 1.0 | 81 | 32 | — |
| Mesh-to-mesh distance | D | B | A | — |
| Volume resistivity (Ωcm) | $1 \times 10^{14}$ | $1 \times 10^{14}$ | $1 \times 10^{-8}$ | — |
| Image evaluation | | | | |
| Evaluation for horizontal streak-like image defect (initial stage) | A | D | A | D |
| Evaluation for blank dot-like image defect | D | D | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-202659, filed Sep. 27, 2013, which is hereby incorporated by reference herein in its entirety.

REFERENCE SIGNS LIST

11 layer of network structural body
12 electroconductive mandrel
13 electroconductive resin layer

What is claimed is:

1. An electroconductive member for electrophotography to be used while being brought into contact with a body to be contacted, the electroconductive member comprising:

an electroconductive support; and a layer of a network structural body on an outer peripheral surface thereof, the network structural body comprising non-electroconductive fibers having an average fiber diameter of a top 10% of fiber diameters measured at arbitrary points of 0.2 to 15 μm, wherein when a surface of the electroconductive member is observed, at least a part of the network structural body exists in an arbitrary square region having one side length of 200 μm, and when a Voronoi tessellation is performed with generating points, the generating points being the non-electroconductive fibers exposed on a cross section in a thickness direction of the layer of the network structural body, areas of Voronoi polygons resulting from the Voronoi tessellation being defined as S1 and cross-sectional areas in the cross section of the non-electroconductive fibers as the generating points of the respective Voronoi polygons being defined as S2, when a ratio "S1/S2" is calculated an arithmetic average kU10 of a top 10% of the ratios is 40 to 160.

2. An electroconductive member for electrophotography according to claim 1, wherein an average thickness t1 of the layer of the network structural body is 10 to 200 μm.

3. An electroconductive member for electrophotography according to claim 1, wherein an average thickness t2 of the layer of the network structural body in a contact portion of the electroconductive member and the body to be contacted is 1 to 50 μm.

4. An electroconductive member for electrophotography according to claim 1, wherein the electroconductive support has an electroconductive resin layer.

5. An electroconductive member for electrophotography according to claim 4, wherein the electroconductive resin layer has electron conductivity.

6. An electroconductive member for electrophotography according to claim 1, further comprising a rigid structural body for protecting the network structural body.

7. An electroconductive member for electrophotography according to claim 6, wherein the rigid structural body is a separation member capable of separating the body to be contacted and the layer of the network structural body by being brought into contact with the body to be contacted.

8. A process cartridge detachably mountable to a main body of an electrophotographic apparatus, the process cartridge comprising the electroconductive member for electrophotography according to claim 1.

* * * * *